US006911784B2

(12) United States Patent
Sasaki et al.

(10) Patent No.: US 6,911,784 B2
(45) Date of Patent: Jun. 28, 2005

(54) DISPLAY APPARATUS

(75) Inventors: Daigo Sasaki, Tokyo (JP); Hideki Asada, Tokyo (JP); Hiroshi Haga, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/630,909

(22) Filed: Jul. 31, 2003

(65) Prior Publication Data

US 2004/0021677 A1 Feb. 5, 2004

Related U.S. Application Data

(63) Continuation of application No. PCT/JP02/00729, filed on Jan. 30, 2002.

(30) Foreign Application Priority Data

Jan. 31, 2001 (JP) ..... 2001-024590

(51) Int. Cl.[7] ..... G09G 3/10; G09G 3/30
(52) U.S. Cl. ..... 315/169.4; 345/77
(58) Field of Search ..... 315/169.1, 169.3, 315/169.4; 345/204, 77, 690, 695, 696

(56) References Cited

U.S. PATENT DOCUMENTS

| | | | | |
|---|---|---|---|---|
| 5,469,281 A | * | 11/1995 | Katakura et al. | 345/89 |
| 5,784,040 A | | 7/1998 | Kobayashi et al. | 345/89 |
| 6,040,911 A | * | 3/2000 | Nozaki et al. | 356/394 |
| 6,097,358 A | * | 8/2000 | Hirakawa et al. | 345/63 |
| 6,714,212 B1 | * | 3/2004 | Tsuboyama et al. | 345/696 |
| 6,756,953 B1 | * | 6/2004 | Tokioka et al. | 345/87 |

FOREIGN PATENT DOCUMENTS

| | | |
|---|---|---|
| EP | 0 471 275 | 2/1992 |
| EP | 0 880 125 | 11/1998 |
| JP | 2-168231 | 6/1990 |
| JP | 3-2722 | 1/1991 |
| JP | 2576765 | 11/1996 |
| JP | 10-68931 | 3/1998 |
| JP | 11-143437 | 5/1999 |
| JP | 11-231827 | 8/1999 |
| JP | 2000-206922 | 7/2000 |

OTHER PUBLICATIONS

Atsushi Togami et al., Estimation of Shape Effect on Area Intensity Method with DT–CNN, pp. 391–398, The Institute of Electronics Information and Communication Engineers.

* cited by examiner

*Primary Examiner*—Don Wong
*Assistant Examiner*—Minh Dieu A
(74) *Attorney, Agent, or Firm*—Young & Thompson

(57) ABSTRACT

A display apparatus according to the present invention includes: a pixel including a plurality of sub-pixels; and a control unit which makes a control such that each of the plurality of sub-pixels is subjected to represent gradation with a plurality of levels. When a first sub-pixel of the plurality of sub-pixels represents one of a minimum gradation level and a maximum gradation level of the gradation with the plurality of levels, the control unit makes a control such that a second sub-pixel adjacent to the first sub-pixel of the plurality of sub-pixels represents other than the other of the minimum gradation level and the maximum gradation level. Thus, the display apparatus according to the present invention can suppress deterioration of picture quality caused by a configuration effect.

22 Claims, 18 Drawing Sheets

| INPUT DATA | | | | |
|---|---|---|---|---|
| DESIRED GRADATION | 1ST FRAME | 2ND FRAME | 3RD FRAME | 4TH FRAME |
| A | A | A | A | A |
| A+0.25 | A+1 | A | A | A |
| A+0.5 | A+1 | A | A+1 | A |
| A+0.75 | A+1 | A+1 | A+1 | A |

230
231
232
233
234
GRADA-TION 0
GRADA-TION 1
GRADA-TION 2
GRADA-TION 3
GRADA-TION 4
240
241
242
243
244
245
246
247
248
249
250
251
252
253
254
255
LEVEL 0
LEVEL 1
LEVEL 2
LEVEL 3
LEVEL 4
LEVEL 5
LEVEL 6
LEVEL 7
LEVEL 8
LEVEL 9
LEVEL 10
LEVEL 11
LEVEL 12
LEVEL 13
LEVEL 14
LEVEL 15

200
201
202
203
204
205
GRADA-TION 0
GRADA-TION 1
GRADA-TION 2
GRADA-TION 3
GRADA-TION 4
GRADA-TION 5
210
211
212
213
214
215
216
217
218
219
220
221
222
223
224
225
LEVEL 0
LEVEL 1
LEVEL 2
LEVEL 3
LEVEL 4
LEVEL 5
LEVEL 6
LEVEL 7
LEVEL 8
LEVEL 9
LEVEL 10
LEVEL 11
LEVEL 12
LEVEL 13
LEVEL 14
LEVEL 15

| OUTPUT | | | |
|---|---|---|---|
| AREA RATIO | 2 : | 1 : | 1 |
| LOWER 2 BITS | SUB-PIXEL 7A | SUB-PIXEL 7B | SUB-PIXEL 7B' |
| 00 | A | A | A |
| 01 | A | A+1 | A |
| 10 | A+1 | A | A |
| 11 | A+1 | A+1 | A |

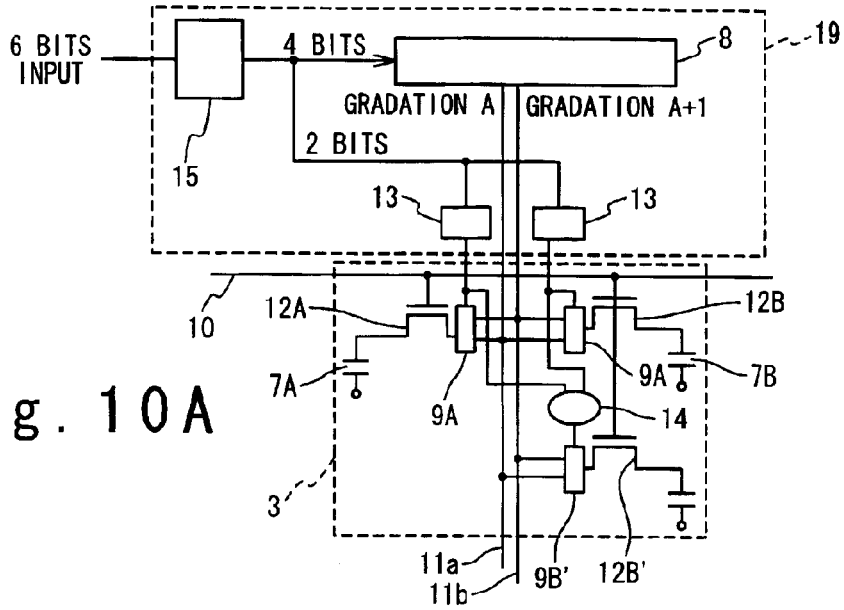
Fig. 10A
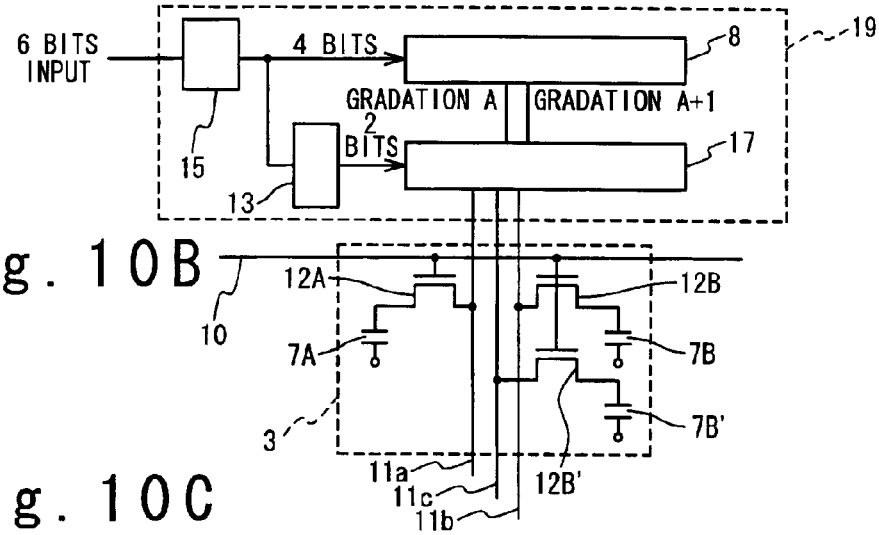
Fig. 10B
Fig. 10C
| OUTPUT | | | | PIXEL OUTPUT |
|---|---|---|---|---|
| AREA RATIO | 2 : | 1 : | 1 | |
| UPPER 2 BITS | SUB-PIXEL 7A | SUB-PIXEL 7B | SUB-PIXEL 7B' | |
| 00 | 0 | 0 | 0 | 0 |
| 01 | 0 | 1 | 0 | 1/4 |
| 10 | 1 | 0 | 0 | 2/4 |
| 11 | 1 | 1 | 1 | 1 |

| OUTPUT | | | PIXEL OUTPUT |
|---|---|---|---|
| AREA RATIO | 2 : | 1 | |
| UPPER 2 BITS | SUB-PIXEL 7A | SUB-PIXEL 7B | |
| 00 | 0 | 0 | 0 |
| 01 | 0 | 1 | 1/3 |
| 10 | 1 | 0 | 2/3 |
| 11 | 1 | 1 | 1 |

| INPUT | OUTPUT | | | |
|---|---|---|---|---|
| | GRADATION A | | GRADATION B | |
| UPPER 4 BITS | FRAME 1/2 | FRAME 2/2 | FRAME 2/2 | FRAME 2/2 |
| 0000 | 0 | 0 | 0 | 1 |
| 0001 | 1 | 0 | 1 | 1 |
| 0010 | 1 | 1 | 1 | 2 |
| 0011 | 2 | 1 | 2 | 2 |
| 0100 | 2 | 2 | 2 | 3 |
| 0101 | 3 | 2 | 3 | 3 |
| 0110 | 3 | 3 | 3 | 4 |
| 0111 | 4 | 3 | 4 | 4 |
| 1000 | 4 | 4 | 4 | 5 |
| 1001 | 5 | 4 | 5 | 5 |
| 1010 | 5 | 5 | 5 | 6 |
| 1011 | 6 | 5 | 6 | 6 |
| 1100 | 6 | 6 | 6 | 7 |
| 1101 | 7 | 6 | 7 | 7 |
| 1110 | 7 | 7 | 7 | 8 |
| 1111 | 8 | 7 | 8 | 8 |

DISPLAY APPARATUS

TECHNICAL FIELD

The present invention relates to a display apparatus. More particularly, the present invention relates to a display apparatus in which a pixel is divided into a plurality of sub-pixels for multiple-gradation representation with high picture quality.

BACKGROUND ART

In recent years, digitization of picture information has been advanced, which leads to a rapid increase of cases where a picture signal is transmitted as a digital signal, although it has been conventionally transmitted as an analog signal.

In conventional CRT, LCD and the like, a gradation control has been made by applying an analog voltage corresponding to a desired analog gradation level to a display apparatus. Then, a variety of digital gradation control methods have come into practical use with the digitization of the picture signal. A complex DAC (Digital-Analog Converter) is not necessary in the digital gradation control method, and therefore simplification of a circuit configuration is expected as compared with a conventional analog gradation control method. Methods for gradation representation include a time divisional representation method and an area gradation representation method. The respective representation methods will be described below.

In the time divisional representation method, switching between a first gradation level and a second gradation level which a pixel represents is made temporally, a time-average is obtained as a third gradation level between the first gradation level and the second gradation level. The method is useful to realize multiple-gradation representation in a display apparatus capable only of carrying out binary representation by changing the time for representation with the first gradation level and the time representation with the second gradation level, namely, by controlling the pulse widths of them. The method is used for a PDP, a ferroelectric LCD, and some of EL represents.

As an area gradation representation method, an "Active Matrix Type Liquid Crystal Display" is disclosed in Japanese Laid Open Patent Application (JP-A-Heisei 10-68931), in which multiple-gradation representation is presented by combining a plurality of pixels, and a simple control configuration can be attained without a complicated multiple-gradation control. In the active matrix type liquid crystal display, a pixel is divided into sub-pixels, and half-tone representation is provided based on a representation area for a picture signal corresponding to binary representation. The active matrix type liquid crystal display includes a plurality of data signal lines arranged in one direction, a plurality of scanning signal lines arranged in a direction crossing the data signal lines, and a plurality of pixels provided in a matrix form. The active matrix type liquid crystal display is characterized in that a data signal line driving circuit for providing an image data for the data signal lines is composed of polysilicon thin film transistors formed on the same substrate together with the pixels, each pixel is composed of a plurality of sub-pixels, and each sub-pixel is driven in binary representation.

Also, Japanese Patent No. 2576765 discloses a "Liquid Crystal Display" with high visibility and a wide visual angle dependency. In this liquid crystal display, one pixel is composed of 2n regions which are made from a combination of n regions (n is an integer equal to or higher than 2) in which orientations of liquid crystal are different and two regions in which voltages applied to the liquid crystal are different from each other and an area ratio of a high voltage region to a low voltage region is from 4:6 to 3:7.

Also, a "Display Apparatus" using a driving method in the digital gradation representation is disclosed in Japanese Laid Open Patent Application (JP-P2000-206922A), in which the area gradation representation method and the time divisional driving method are combined, no gradation inversion due to an accumulation response occurs, and a good multiple-gradation representation is attained. In a method of driving gradation representation in which a pixel division ratio is S1:S2=1:2 and a time division ratio is T1:T2:T3=1:4:16, for example, the time division ratio is set as T1:T2:T3:T4=1:4:8:8. In this display apparatus, if there is an area error d in S2, the gradation transition is caused for one level, for example, from a level 23 to a level 24 but a gradation error is reduced by using the above-mentioned time division ratio.

Japanese Laid Open Patent Application (JP-A-Heisei 11-231827) discloses an "Image Display Apparatus" which can reduce occurrence of a false contour of dynamic picture image less than ever before. In this image display apparatus, one TV field is configured by temporally arranging N sub-fields, each of which has a brightness weight, and a picture of the TV field is presented in multiple-gradation representation by lighting desired sub-fields. The image display apparatus is characterized by including: a selecting section for selecting one gradation level according to the amount of the motion of an input picture from gradation levels that can be displayed by combining any ones of 0, W1, W2 to WN as the brightness weights of the sub-fields; and a sub-field lighting section for lighting up the sub-field which represents the selected gradation level.

Although several area gradation representation methods have been proposed ever, the fact that there are problems with regard to picture quality was mentioned by Atsushi Togami et al. in "Estimation of Shape Effect on Area Intensity Method with DT-CNN" in pages 391–398 of "Technical Report of IEICE. NC-96-206 (1997.3)". According to the paper, deterioration of picture quality like a flaw occurs in a gray scale portion, because movement of a center of gradation is large in some portion in the area gradation representation method.

Consider a simple example. As shown in FIG. 19A, there are two sub-pixels 6A and 6B for 2-gradation-level representation in each pixel 3X, in which an area ratio is 1:2. Here, it is assumed that each of the sub-pixels 6A and 6B has two gradation levels. In this case, it could be understood from 2·2=4 that 4-gradation-level representation is possible in the pixel 3X, as shown in FIG. 19B. A numeral 710 indicates a pixel gradation level 0, and both sub-pixels 6A and 6B represent black (for example, a non-lighting condition). A numeral 711 indicates a pixel gradation level 1, the sub-pixel 6B represents black, and the sub-pixel 6A represents white (for example, lighting condition). A numeral 712 indicates a pixel gradation level 2, the sub-pixel 6B represents white, and the sub-pixel 6A represents black. A numeral 713 indicates a pixel gradation level 3, the sub-pixel 6B represents white, and the sub-pixel 6A represents white.

In such a configuration of pixel and gradation, desired gradation characteristics can not be obtained when an image is displayed by using a plurality of pixels which are actually arrayed in a matrix. FIG. 20 shows a gradation from black (shaded portion) to white as an example of image display.

This gradation corresponds to change from the pixel gradation level 0 to the pixel gradation level 1, the pixel gradation level 2 and the pixel gradation level 3 shown in FIG. 19B. In FIG. 20, an "arrow ↑ of solid line" indicates the separation between pixels. At the switching from the pixel gradation level 1 to the pixel gradation level 2 in the gradation, a white portion appears for the width of one pixel as shown by "arrows ↑ of dashed lines". This phenomenon is caused by a movement of a center of the gradation as a whole due to the large difference in gradation representation between sub-pixels of one pixel (difference in brightness between sub-pixels). Hereafter, this phenomenon is referred to as a false contour. Because of such movement of the center of the gradation, this gradation can not be seen as a smooth gradation variation by the human eye, resulting in the deterioration of picture quality. Moreover, in the case of a color gradation, the movement of a center of the color gradation occurs individually for each color, resulting in a problem that a false color appears in a contour portion.

Also, another factor of the deterioration of picture quality is appearance of a periodical pattern associated with periodicity of the sub-pixels as can be seen in the example of the image display in FIG. 20. In FIG. 20, there is a narrow black representation portion in a switching area from the pixel gradation level 2 to the pixel gradation level 3, and the portion appears as a vertical line. Such a pattern is caused by pixel configuration, and can be prevented by a complex pixel configuration (to be more precise, by making a sub-pixel more minute and making the spatial resolution higher so that it can not be felt by the human eye). However, it is not practical to make the pixel configuration more complicated.

In an example of representation shown in FIG. 19A, the number of sub-pixels is 2 and the area ratio is 1:2. The deterioration of picture quality occurs even if the number of sub-pixels is set to n and the area ratio is set to $1:2^1:2^2:\ldots:2^{n-1}$ (n is an integer equal to or more than one) in order to present the further multiple-gradation representation in one pixel.

The present invention is accomplished in view of the above mentioned problems.

Therefore, an object of the present invention is to provide a display apparatus, which uses an area gradation representation method that a pixel is divided into a plurality of sub-pixels, and the deterioration of picture quality due to a pixel configuration effect is suppressed.

Another object of the present invention is to provide a display apparatus, in which picture quality substantially equivalent to that of an analog gradation representation method can be obtained by a combination with a time divisional driving method.

Still another object of the present invention is to provide a display apparatus that can present an area gradation representation with 64-gradation-level representation and high picture quality.

Still another object of the present invention is to provide a display apparatus that can present an area gradation representation with higher picture quality by suppressing difference in brightness.

Still another object of the present invention is to provide a method of gradation representation by which the configuration effect is restrained and higher picture quality is achieved.

DISCLOSURE OF INVENTION

In an aspect of the present invention, a display apparatus includes a pixel including a plurality of sub-pixels capable of representing a plurality of gradation levels, and a source driver which receives an input data, and outputs a plurality of data signals to the pixel based on the input data to control the plurality of sub-pixels. When a first sub-pixel of the plurality of sub-pixels represents one of a minimum gradation level and a maximum gradation level of the plurality of gradation levels, a second sub-pixel of the plurality of sub-pixels adjacent to the first sub-pixel represents other than the other of the minimum gradation level and the maximum gradation level.

The plurality of sub-pixels can carry out gradation representation by using two gradation levels at a time. The two gradation levels out of the plurality of gradation levels are referred to as a first gradation level and a second gradation level. Moreover, the first gradation level can be one level different from the second gradation level. As a result of using the two gradation levels for the plurality of sub-pixels, the pixel can represent a gradation level between the first gradation level and the second gradation level. Thus, multiple-gradation representation in the display apparatus is possible with a simple configuration. Since the first gradation level and the second gradation level are close to each other, the display apparatus according to the present invention can suppress deterioration of picture quality caused by the configuration effects such as false contour, false color and so on.

The source driver includes a gradation voltage generator and a selector. The gradation voltage generator receives a first set of bits in the input data (for example, the upper four bits of the input data including six bits). Then, the gradation voltage generator generates a first gradation voltage corresponding to the first gradation level and a second gradation voltage corresponding to the second gradation level based on the first set of bits.

The selector receives a second set of bits in the input data (for example, the lower two bits of the input data including six bits) together with the first gradation voltage and the second gradation voltage generated by the gradation voltage generator. Then, the selector selects one of the first gradation voltage and the second gradation voltage to be sent to each of the plurality of sub-pixels as one of the plurality of data signals based on the second set of bits. It is also possible to provide the selector for each of the plurality of sub-pixels.

The source driver can further include a memory and an input signal interchange unit. The memory stores a plurality of bits of data (for example, two bit data). The input signal interchange unit receives the input data and selects one of a first mode and a second mode of gradation representation.

In the first mode, the input signal interchange unit outputs a third set of bits in the input data (for example, the upper four bits) to the gradation voltage generator and a fourth set of bits in the input data (for example, the lower two bits) to the memory. The memory outputs the fourth set of bits to the selector.

In the second mode, the input signal interchange unit outputs a fifth set of bits in the input data (for example, the lower four bits) to the gradation voltage generator and a sixth set of bits in the input data (for example, the upper two bits) to the memory. The second mode is for representing a static image. By using the data stored in the memory, the display apparatus can operate with low power consumption. In this case, a calculator can be used together, which receives the sixth set of bits outputted from the memory, performs a calculation, and outputs a calculation result to at least one of the plurality of sub-pixels.

The source driver can further include an input signal converting unit which receives the input data, and outputs a quotient and a residual obtained by dividing the input data by a natural number to the gradation voltage generator and to the selector, respectively.

The source driver can divide the input data into m frames of data, and scans each of the plurality of sub-pixels m times to represent the first gradation level p times and the second gradation level q times (p and q are equal to or more than 0). Here, the number m is represented by an equation m=p+q, and the numbers p and q are different according to the plurality of sub-pixels.

The number of the plurality of sub-pixels can be 2, and an area ratio of the plurality of sub-pixels can be 1:2. In the display apparatus according to the present invention, gradation inversion which is a peculiar problem with area gradation representation never occurs due to the sub-pixel capable of multiple-gradation representation.

The number of the plurality of sub-pixels can be n (n is an integer equal to or more than 1), and an area ratio of the plurality of sub-pixels can be $1:2^1:2^2: \ldots :2^{n-1}$. Or, the number of the plurality of sub-pixels in the pixel can be n, and an area ratio of the plurality of sub-pixels can be $1:1:2^1:2^2: \ldots :2^{n-2}$ (n is an integer equal to or more than 2). Thus, in the display apparatus according to the present invention, the gradation which the sub-pixels can represent becomes at least multiple-gradation.

BRIEF DESCRIPTION OF DRAWINGS

FIGS. 10A and 10B are views showing another configuration of the pixel and the source driver of the display apparatus according to the second embodiment;

FIG. 10C is a view showing contents which the pixel outputs;

BEST MODE FOR CARRYING OUT THE INVENTION

Embodiments of a display apparatus according to the present invention will be described below with reference to the attached drawings.

(First Embodiment)

Figure 1:
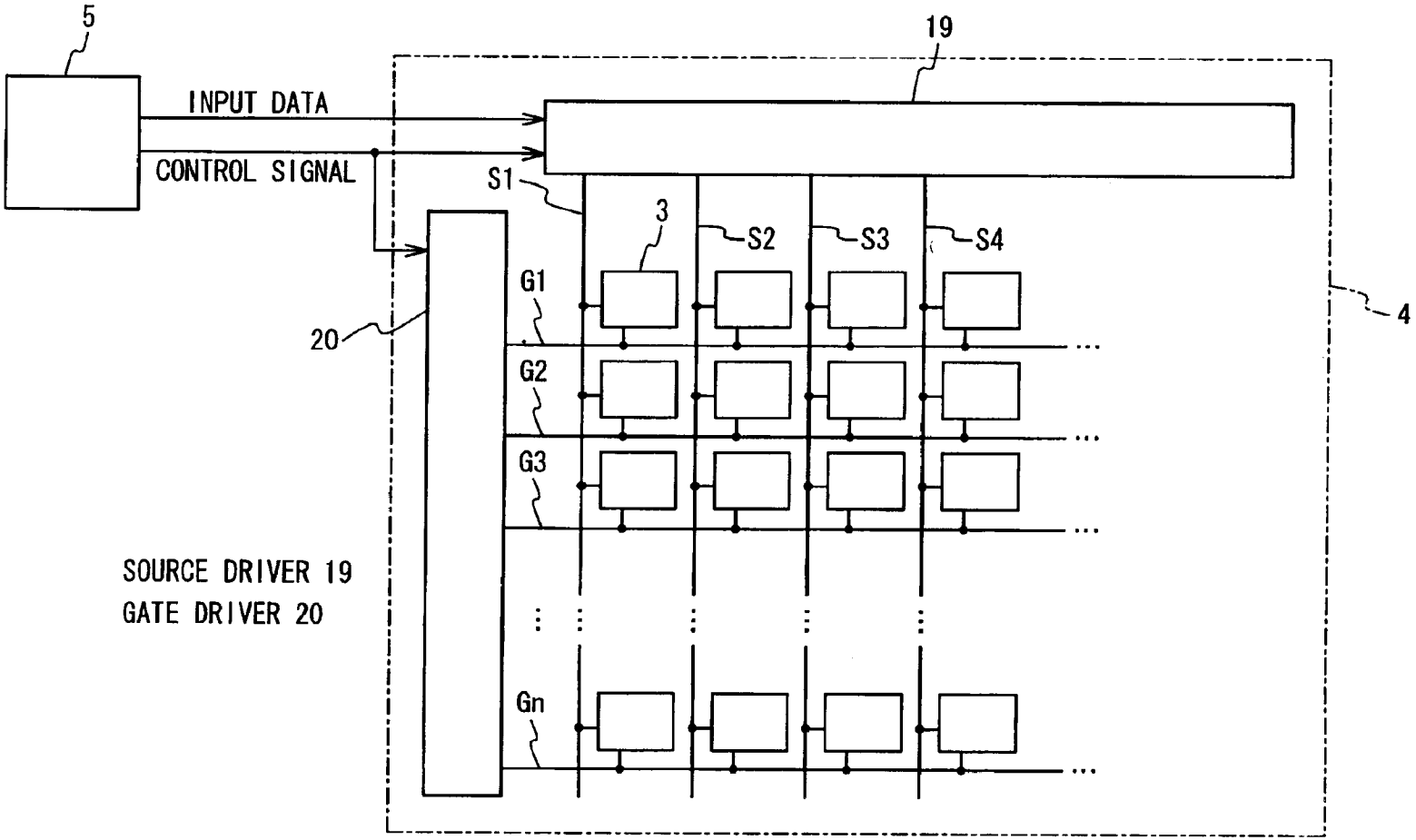
FIG. 1 is a block diagram showing a configuration of a display apparatus according to a first embodiment.

FIG. 1 is a block diagram showing a configuration of a display apparatus according to the first embodiment.

Figure 2:
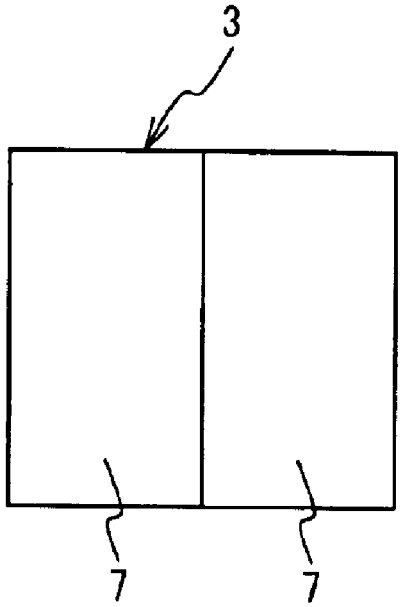
FIG. 2 is a view showing a configuration of a pixel in a display panel.

FIG. 2 shows a configuration of a pixel in a display panel.

As shown in FIG. 1, the display apparatus according to the first embodiment is a dot matrix display apparatus. The display apparatus according to the first embodiment is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving the scanning lines G1, G2, . . . Gn such that the scanning signals are sequentially supplied to the scanning lines G1, G2, . . . Gn; and a source driver 19 driving the data lines S1, S2, . . . such that the data signals are supplied to the data lines S1, S2 . . . , and a control unit 5 which controls the data signals such that the pixels 3 represent image data. It should be noted that n is any positive integer.

The control unit 5 receives an image data as an external data, converts the image data into an input data corresponding to the data signal, and outputs to the source driver 19. Also, the control unit 5 generates a control signal for driving the display panel 4 in response to an external signal, and outputs the control signal to the source driver 19 and the gate driver 20. The control signal is used for driving the source driver 19 and the gate driver 20 in order to write the input data to any pixels 3.

Each pixel 3 is composed of sub-pixels 7, 7 that allow multiple-gradation representation and are adjacent to each other, as shown in FIG. 2, for example. Here, the sub-pixel 7 corresponds to a pixel electrode or a capacitor. For example, a TFT (Thin Film Transistor) as a switching element is provided at each intersection in matrix interconnections which are formed by the scanning lines G1, G2, . . . Gn and the data lines S1, S2 . . . . A gate electrode of the TFT is connected to a corresponding one of the scanning lines G1, G2, . . . Gn, a source electrode thereof is connected to a corresponding one of the data lines S1, S2 . . . , and a drain electrode thereof is connected to the pixel electrode (sub-pixel 7). The control unit 5 mentioned above controls gradation of data displayed in the sub-pixels 7, 7.

In order to prevent the deterioration of picture quality due to the pixel configuration effect, it is desirable to reduce a brightness difference between the sub-pixels 7 in each pixel 3 so that the pixel configuration effect becomes inconspicuous. There are two methods to reduce the brightness difference between the sub-pixels 7. One method is to increase the number of gradation levels which the sub-pixels 7 can represent. Another method is to temporally change the gradation which the sub-pixels 7 represent for every frame, and thereby increase the number of gradation levels. Accordingly, the brightness difference is reduced. When a first sub-pixel of the plurality of sub-pixels (for example, one of the two sub-pixels 7) represents one of a minimum gradation level and a maximum gradation level among the plurality of gradation levels, the control unit 5 carries out a control so that a second sub-pixel adjacent to the first sub-pixel among the plurality of sub-pixels (for example, another of the two sub-pixels 7) does not represent the other of the minimum gradation level and the maximum gradation level among the plurality of gradation levels. Thus, it is possible to prevent a combination of gradation levels of the sub-pixels 7 by which the brightness difference becomes maximum among brightness differences that may occur in the pixel 3. As the brightness difference between the sub-pixels is reduced, picture quality is improved.

Furthermore, when the gradation levels selected in the pixel 3 are closer to each other, it becomes easier to select a signal in driving actually. Therefore, even if the number of the sub-pixels 7 is equal to or more than 3 (for example, if one of the two sub-pixels 7 is further divided), the number of the gradation levels used in each pixel is desired to be 2. Moreover, even if the number of the sub-pixels 7 is 2 or more, it is preferable that two gradation levels to be selected should be two gradation levels which are adjacent to each other (two gradation levels with small brightness difference among the plurality of gradation levels), in order to reduce the brightness difference as much as possible. When a first sub-pixel of the plurality of sub-pixels (for example, one of the two sub-pixels 7) represents one of a minimum gradation level and a maximum gradation level among the plurality of gradation levels, the control unit 5 carries out a control so that a second sub-pixel adjacent to the first sub-pixel among the plurality of sub-pixels (for example, another of the two sub-pixels 7) does not represent the other of the minimum gradation level and the maximum gradation level among the plurality of gradation levels. Thus, it is possible to reduce the brightness difference.

Next, a necessary configuration of the control unit 5 to change temporally the gradation which the sub-pixels 7 represent for every frame will be described below with reference to FIGS. 3A and 3B.

Figures 3A, 3B:
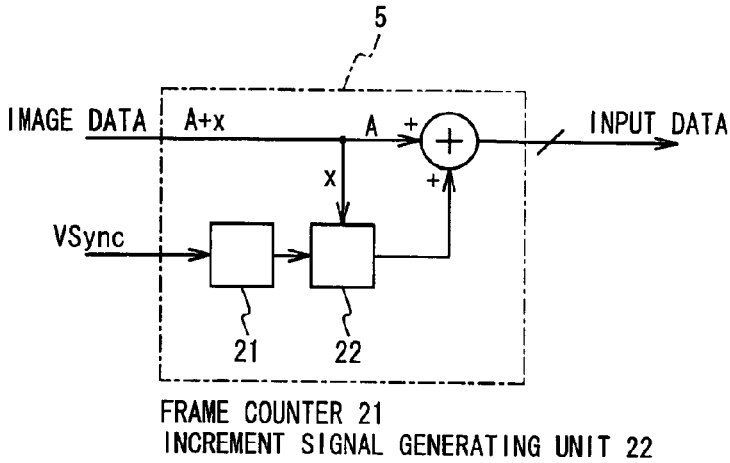
FIG. 3A is a view showing a configuration of a control unit of the display apparatus according to the first embodiment.
FIG. 3B is a view showing contents of an input data outputted by the control unit of the display apparatus according to the first embodiment.

FIG. 3A is a figure showing the configuration of the control unit of the display apparatus according to the first embodiment, and FIG. 3B shows contents of input data outputted from the control unit of the display apparatus according to the first embodiment.

As shown in FIG. 3A, the control unit 5 receives an image data for one period and divides the input data into a plurality of frames based on the image data. Then, the control unit 5 makes a control such that a pixel is scanned a plurality of times, and a gradation which the sub-pixel 7 represents (or referred to as a gradation level voltage) is changed temporally for every frame, and the number of gradation levels which the pixel can represent increases at a time-average. When the input data is divided into four frames, for example, the control unit 5 makes it possible to represent the input data at the sub-pixel 7 in not only adjacent two gradation levels A and A+1 (which is by one level higher than the gradation level A) which can be usually displayed but also gradation levels of A+0.25, A+0.5, and A+0.75 additionally. The control unit 5 has a frame counter 21 for counting the frames based on a timing signal VSync from an external portion, and an increment signal generating unit 22 which receives a data x in a gradation data A+x (x=0.25, 0.5 or 0.75) from the external portion and adds one to the gradation A for the image data based on a count value from the frame counter 21.

For example, if the gradation level A+0.25 is desired for representation, the increment signal generating unit 22 divides the image data of one period including the gradation level A into four frames. The gradation level A is included in each of the divided four frames. Next, the increment signal generating unit 22 is set to output one to only one of the four frames based on the count value from the frame counter 21. In this case, the control unit 5 uses the image data of the gradation level A+0.25 from the external portion, inputs a component of 0.25 that can not be represented in the sub-pixel to the increment signal generating unit 22, and then adds one to only the gradation level A for the first frame among the four frames based on the data. That is, the gradation level A+1 is used in the first frame, while the gradation level A is used in the other frames. Thus, an average of output gradation levels outputted by the increment signal generating unit 22 is A+0.25. The control unit 5 outputs the four frames representing the gradation levels A+1, A, A and A as the input data (data signal) to the source driver 19. Also, when an image data including the gradation level A+1 is received from the external portion, the control unit 5 outputs the four frames representing the gradation levels A+1, A+1, A+1 and A+1 as the input data (data signal) to the source driver 19 without intervention of the increment signal generating unit 22.

As shown in FIG. 3B, when representation with the gradation level A is desired (the image data has the desired gradation level A as in FIG. 3B), the gradation level A is used from the first frame to the fourth frame. In this case, an average of the output gradation levels outputted by the increment signal generating unit 22 is 0. The control unit 5 outputs the four frames representing the gradation levels A, A, A and A as the input data (data signal) to the source driver 19. When representation with the gradation level A+0.25 is desired (the image data has the desired gradation level A+0.25 as in FIG. 3B), the sub-pixels 7 represent the input data with the gradation level A+1 for the first frame, and the sub-pixels 7 represent the input data with the gradation level A for the frames from the second frame to the fourth frame. In this case, an average of the output gradation levels outputted by the increment signal generating unit 22 is 0.25. The control unit 5 outputs the four frames representing the gradation levels A+1, A, A and A as the input data (data signal) to the source driver 19. When representation with the gradation level A+0.5 is desired (the image data has the desired gradation level A+0.5 as in FIG. 3B), the sub-pixels 7 represent the input data with the gradation level A+1 for the first frame and the third frame, and the sub-pixels 7 represent the input data with the gradation level A for the second frame and the fourth frame. In this case, an average of the output gradation levels outputted by the increment signal generating unit 22 is 0.5. The control unit 5 outputs the four frames representing the gradation levels A+1, A, A+1 and A as the input data (data signal) to the source driver 19. When representation of the gradation level A+0.75 is desired (the image data has the desired gradation level A+0.75 as in FIG. 3B), the sub-pixels 7 represent the input data with the gradation level A+1 for the first frame, second frame and the third frame, and the sub-pixels 7 represent the input data with the gradation level A for the fourth frame. In this case, an average of the output gradation levels outputted by the increment signal generating unit 22 is 0.75. The control unit 5 outputs the four frames representing the gradation levels A+1, A+1, A+1 and A as the input data (data signal) to the source driver 19.

The improvement of picture quality resulting from the usage of the above-mentioned display apparatus will be described below with reference to FIGS. 4A, 4B, 4C and 5.

Figure 4A:
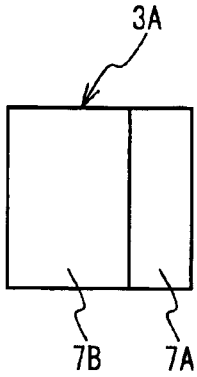
FIG. 4A is a view showing a configuration of a pixel in the display panel of the display apparatus according to the first embodiment.
Figure 4B:
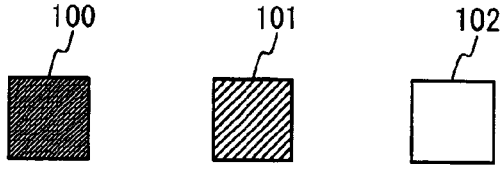
FIG. 4B is a view showing gradation levels used in the display apparatus according to the first embodiment.
Figure 4C:
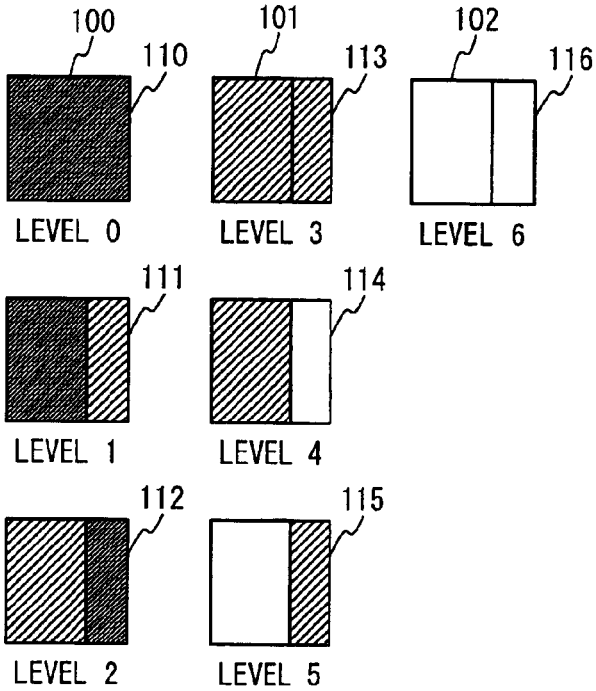
FIG. 4C is a view showing gradation representation in the display apparatus according to the first embodiment.

FIG. 4A shows a configuration of a pixel in a display panel of the display apparatus according to the first embodiment. FIG. 4B shows gradation levels used in the display apparatus according to the first embodiment. FIG. 4C shows gradation representation in the display apparatus according to the first embodiment.

Figure 5:
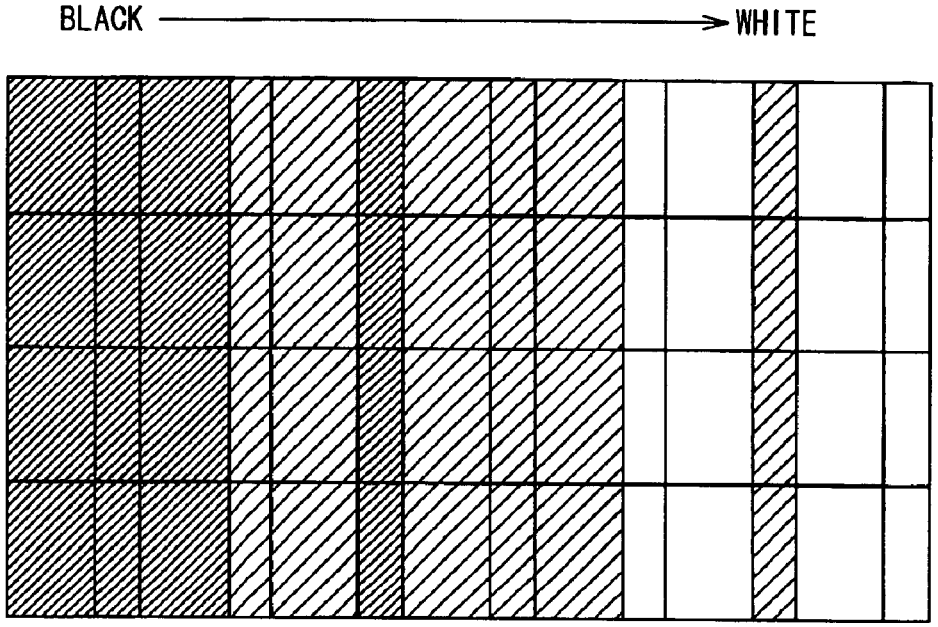
FIG. 5 is a view showing a gradation using the pixel shown in FIG. 4C.

FIG. 5 is a figure showing a gradation using the pixel in FIG. 4C.

Figure 20:
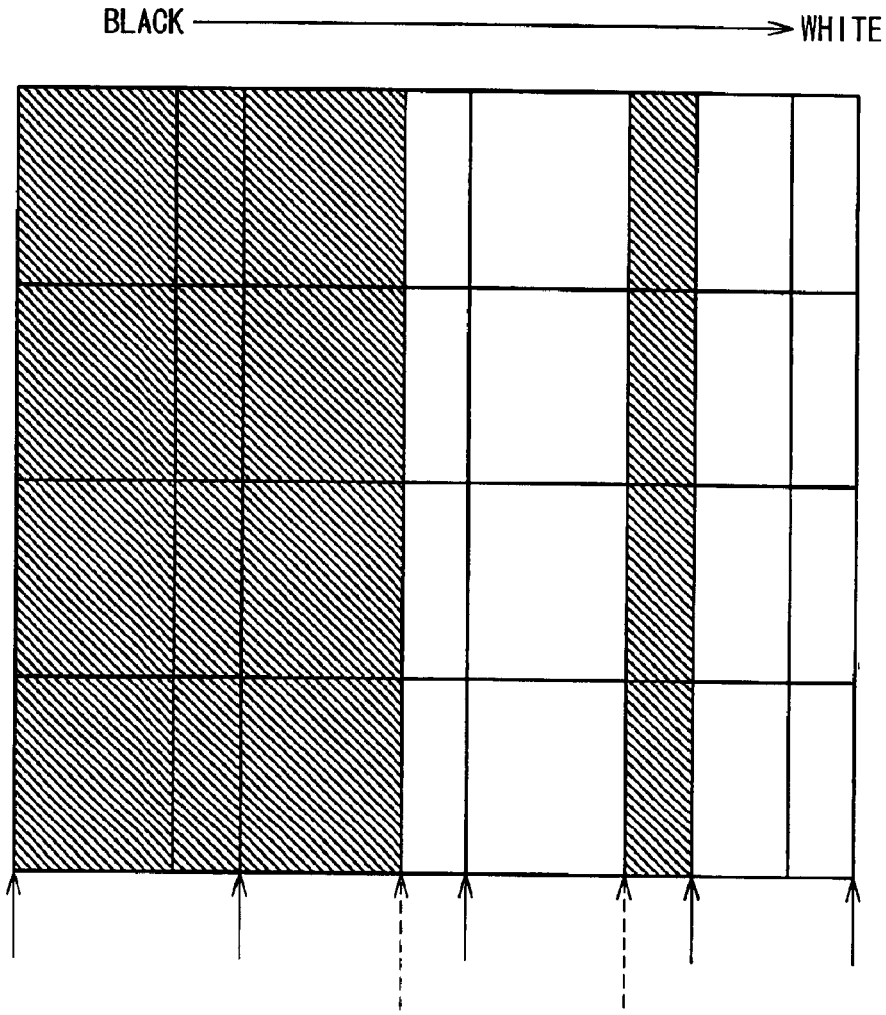
Fig. 20 PRIOR ART
FIG. 20 is a view showing a gradation using the pixel shown in FIG. 19B.

As shown in FIG. 4A, a numeral 3A shows a pixel corresponding to the pixel 3 of the display panel 4. The pixel 3A is composed of two sub-pixels 7A and 7B, and an area ratio between the sub-pixels 7A and 7B is 1:2. Here, in the configuration of the pixel 3A, the number of gradation levels is three as shown in FIG. 4B. In this case, a numeral 100 indicates a gradation level 0 (for example, black), a numeral 101 indicates a gradation level 1, and a numeral 102 indicates a gradation level 2 (for example, white) as shown in FIG. 4C, and 7-gradation-level representation is possible thereby. Here, in the time division representation method, for example, the gradation level 0 corresponds to the above-mentioned gradation level A, the gradation level 1 corresponds to the above-mentioned gradation level A+0.5, and the gradation level 2 corresponds to the above-mentioned gradation level A+1. Thus, 7-gradation-level representation is possible similarly. A numeral 110 indicates level 0, and both sub-pixels 7A and 7B represent the gradation level 0. A numeral 111 indicates level 1, the sub-pixel 7B represents the gradation level 0, and the sub-pixel 7A represents the gradation level 1. A numeral 112 indicates level 2, the sub-pixel 7B represents the gradation level 1, and the sub-pixel 7A represents the gradation level 0. A numeral 113 indicates level 3, and both sub-pixels 7A and 7B represent the gradation level 1. A numeral 114 indicates level 4, the sub-pixel 7B represents the gradation level 1, and the sub-pixel 7A represents the gradation level 2. A numeral 115 indicates level 5, the sub-pixel 7B represents the gradation level 2, and the sub-pixel 7A represents the gradation level 1. A numeral 116 indicates level 6, and both sub-pixels 7A and 7B represent the gradation level 2. FIG. 5 shows an example of a gradation from black (corresponding to the numeral 100) to white displayed by using these gradation levels. As compared with the conventional technique shown in FIG. 20, the change in the gradation becomes half (for example, the sub-pixel 7B adjacent to the sub-pixel 7A and representing black represents an intermediate color between black and white), which makes it possible to reproduce a smooth gradation representation. Hence, picture quality can be improved by reducing the brightness difference between the sub-pixels.

Consequently, in order to reduce the deterioration of picture quality mentioned above, the configuration is useful in which the brightness difference between the sub-pixels is restrained as much as possible. Such configuration can suppress the false contour and the false color mentioned above in the display apparatus according to the first embodiment. Moreover, the view angle property is different depending on the gradation level in a display apparatus using liquid crystal, and hence the deterioration of picture quality becomes conspicuous when there is a large brightness difference in the pixels. Therefore, this configuration is further effective.

As described above, in the display apparatus according to the first embodiment, the decrease in picture quality due to the pixel configuration effect can be suppressed in the area gradation representation method which presents gradation representation by dividing a pixel into a plurality of sub-pixels.

Also, in the display apparatus according to the first embodiment, picture quality which is substantially equal to that of an analog gradation representation method can be obtained by a combination with a time division driving method.

(Second Embodiment)

A display apparatus according to the second embodiment will be described below with reference to FIGS. 6A, 6B, 7A and 7B, in which the number of gradation levels is increased in order to reduce brightness difference between sub-pixels. It should be noted that the configuration of the display apparatus in the second embodiment is similar to that in the first embodiment, and the explanation is omitted.

Figures 6A, 6B:
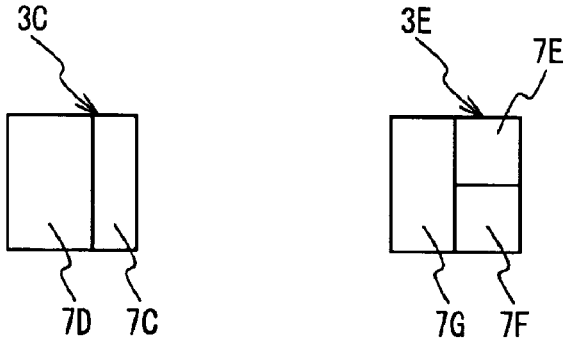
FIG. 6A is a view showing an example of configuration of a pixel in a display panel of a display apparatus according to a second embodiment.
FIG. 6B is a view showing another example of configuration of the pixel in the display panel of the display apparatus according to the second embodiment.

FIG. 6A shows a configuration example of a pixel in a display panel of the display apparatus according to the second embodiment, and FIG. 6B shows another configuration example of the pixel in the display panel of the display apparatus according to the second embodiment.

Figure 7B:
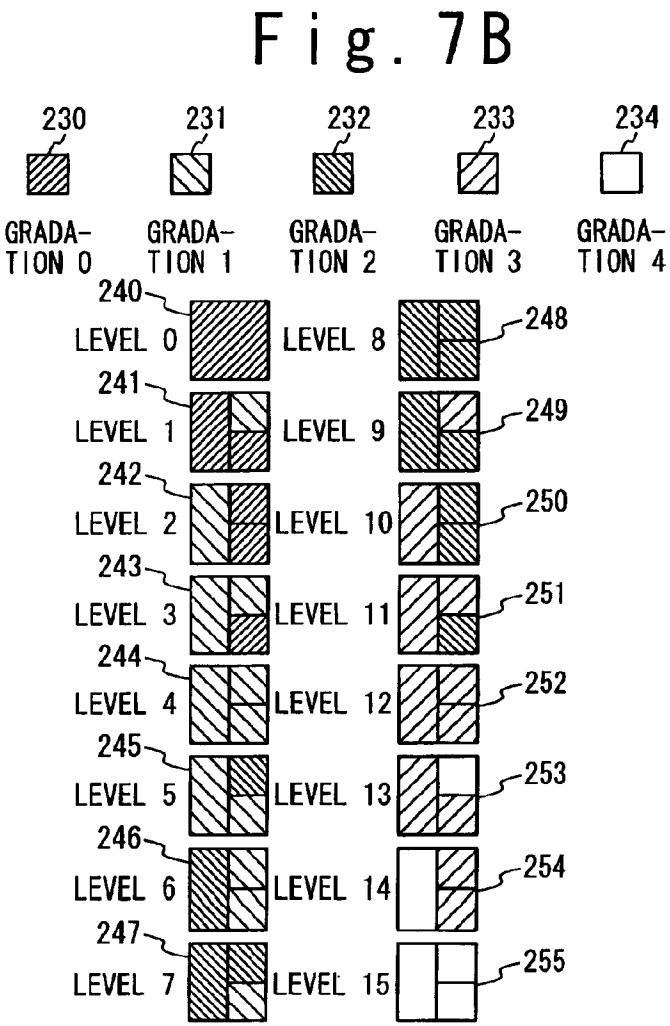
FIG. 7B is a view showing gradation representation with the pixel shown in FIG. 6B.
Figure 7A:
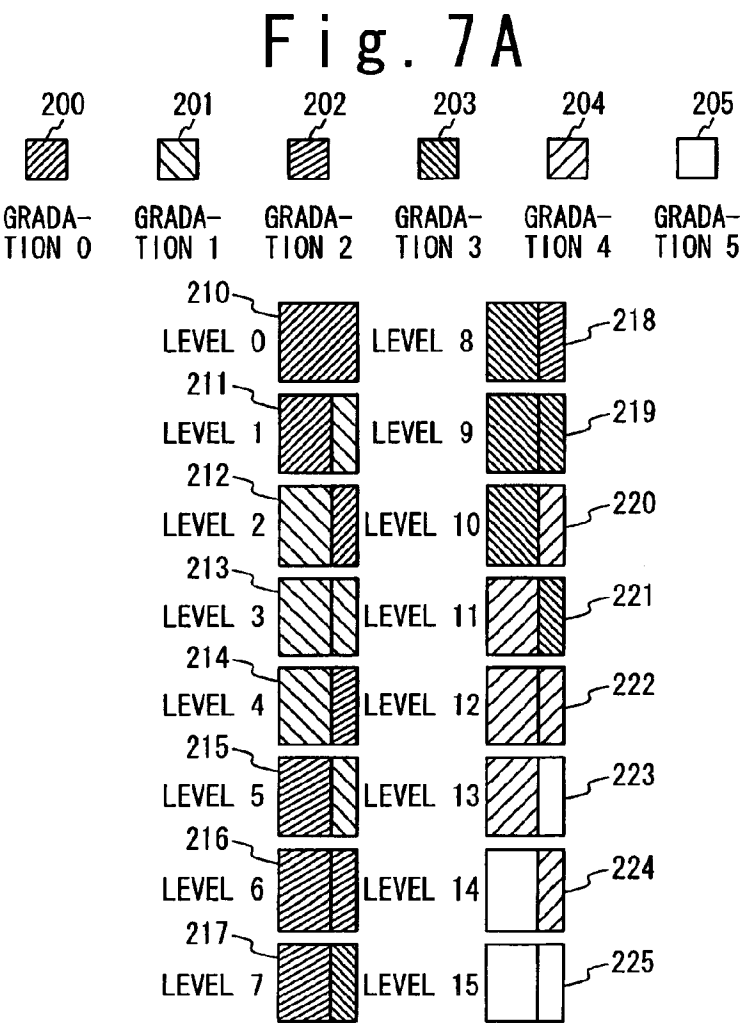
FIG. 7A is a view showing gradation representation with the pixel shown in FIG. 6A.

FIG. 7A shows gradation representation in the case of the pixel in FIG. 6A. FIG. 7B shows gradation representation in the case of the pixel in FIG. 6B.

Here, for example, representation with 16 gradation levels is considered using the configuration of the sub-pixels shown in FIGS. 6A and 6B. As shown in FIG. 6A, a numeral 3C indicates a pixel corresponding to the pixel 3 of the display panel 4. The pixel 3C is composed of sub-pixels 7C and 7D which are adjacent to each other, and an area ratio between the sub-pixels 7C and 7D is 1:2. Also, the number of gradation levels is six in the configuration of the pixel 3C. In this case, as shown in FIG. 7A, a numeral 200 indicates a gradation level 0 (for example, black), a numeral 201 indicates a gradation level 1, a numeral 202 indicates a gradation level 2, a numeral 203 indicates a gradation level 3, a numeral 204 indicates a gradation level 4, and a numeral 205 indicates a gradation level 5 (for example, white). Thus, 6-gradation-level representation is possible. Also, as a gradation level shifts from the gradation level 0 to the gradation level 5, the color becomes gradually lighter from "Black" to "White" as shown in FIG. 7A.

As shown in FIG. 7A, a numeral 210 indicates level 0, and both the sub-pixels 7C and 7D represent the gradation level 0. A numeral 211 indicates level 1, the sub-pixel 7D represents the gradation level 0, and the sub-pixel 7C represents the gradation 1. A numeral 212 indicates level 2, the sub-pixel 7D represents the gradation level 1, and the sub-pixel 7C represents the gradation level 0. A numeral 213 indicates level 3, and both the sub-pixels 7C and 7D represent the gradation level 1. A numeral 214 indicates level 4, the sub-pixel 7D represents the gradation level 1, and the sub-pixel 7C represents the gradation level 2. A numeral 215 indicates level 5, the sub-pixel 7D represents the gradation level 2, and the sub-pixel 7C represents the gradation level 1. A numeral 216 indicates level 6, and both the sub-pixels 7C and 7D represent the gradation level 2. A numeral 217 indicates level 7, the sub-pixel 7D represents the gradation level 2, and the sub-pixel 7C represents the gradation level 3. A numeral 218 indicates level 8, the sub-pixel 7D represents the gradation level 3, and the sub-pixel 7C represents the gradation level 2. A numeral 219 indicates level 9, and both the sub-pixels 7C and 7D represent the gradation level 3. A numeral 220 indicates level 10, the sub-pixel 7D represents the gradation level 3, and the sub-pixel 7C represents the gradation level 4. A numeral 221 indicates level 11, the sub-pixel 7D represents the gradation level 4, and the sub-pixel 7C represents the gradation level 3. A numeral 222 indicates level 12, and both the sub-pixels 7C and 7D represent the gradation level 4. A numeral 223 indicates level 13, the sub-pixel 7D represents the gradation level 4, and the sub-pixel 7C represents the gradation level 5. A numeral 224 indicates level 14, the sub-pixel 7D represents the gradation level 5, and the sub-pixel 7C represents the gradation level 4. A numeral 225 indicates level 15, and both the sub-pixels 7C and 7D represent the gradation level 5.

Also, as shown in FIG. 6B, a numeral 3E indicates a pixel corresponding to the pixel 3 of the display panel 4. The pixel 3E is composed of sub-pixels 7E, 7F and 7G which are adjacent to each other, and an area ratio of the sub-pixels 7E, 7F and 7G is 1:1:2. Also, the necessary number of gradation levels is 5 in the configuration of the pixel 3E. In this case, as shown in FIG. 7B, a numeral 230 indicates a gradation level 0 (for example, black), a numeral 231 indicates a gradation level 1, a numeral 232 indicates a gradation level 2, a numeral 233 indicates a gradation level 3, and a numeral 234 indicates a gradation level 4. (for example, white). Thus, 5-gradation representation is possible. Also, as a gradation shifts from the gradation level 0 to the gradation level 4, the color becomes gradually lighter from "Black" to "White" as shown in FIG. 7B.

As shown in FIG. 7B, a numeral 240 indicates level 0, and all the sub-pixels 7E, 7F and 7G represent the gradation level 0. A numeral 241 indicates level 1, the sub-pixels 7F and 7G represent the gradation level 0, and the sub-pixel 7E represents the gradation level 1. A numeral 242 indicates level 2, the sub-pixels 7E and 7F represent the gradation level 0, and the sub-pixel 7G represents the gradation level 1. A numeral 243 indicates level 3, the sub-pixels 7E and 7G represent the gradation level 1, and the sub-pixel 7F represents the gradation level 0. A numeral 244 indicates level 4, and all the sub-pixels 7E, 7F and 7G represent the gradation level 1. A numeral 245 indicates level 5, the sub-pixel 7E represents the gradation level 2, and the sub-pixels 7F and 7G represent the gradation level 1. A numeral 246 indicates level 6, the sub-pixel 7G represents the gradation level 2, and the sub-pixels 7E and 7F represent the gradation level 1. A numeral 247 indicates level 7, the sub-pixels 7E and 7G represent the gradation level 2, and the sub-pixel 7F represents the gradation level 1. A numeral 248 indicates level 8, and all the sub-pixels 7E, 7F and 7G represent the gradation level 2. A numeral 249 indicates level 9, the sub-pixel 7E represents the gradation level 3, and the sub-pixels 7F and 7G represent the gradation level 2. A numeral 250 indicates level 10, the sub-pixel 7G represents the gradation level 3, and the sub-pixels 7E and 7F represent the gradation level 2. A numeral 251 indicates level 11, the sub-pixels 7E and 7G represent the gradation level 3, and the sub-pixel 7F represents the gradation level 2. A numeral 252 indicates level 12, and all the sub-pixels 7E, 7F and 7G represent the gradation level 3. A numeral 253 indicates level 13, the sub-pixel 7E represents the gradation level 4, and the sub-pixels 7F and 7G represent the gradation level 3. A numeral 254 indicates level 14, the sub-pixel 7G represents the gradation level 4, and the sub-pixels 7E and 7F represent the gradation level 3. A numeral 255 indicates level 15, and all the sub-pixels 7E, 7F and 7G represent the gradation level 4.

As shown in FIGS. 7A and 7B, it is clear that the inversion of the gradation, which is a problem peculiar to the area gradation representation method using the sub-pixel capable of multiple-gradation representation, is not caused in the display apparatus according to the second embodiment. Therefore, in the display apparatus according to the second embodiment, picture quality is improved as compared with the conventional area gradation representation method.

In the display apparatus according to the second embodiment mentioned above, the area ratio of the sub-pixels in the pixel is 1:2 as in FIG. 6A or the area ratio of the sub-pixels in the pixel is 1:1:2 as in FIG. 6B. The number of the sub-pixels can be further increased. In that case, at least multiple-gradation representation of the sub-pixels 7E, 7F and 7G becomes possible in the display apparatus according to the second embodiment by dividing n sub-pixels with an area ratio of $1:1:2^1:2^2:\ldots:2^{n-2}$ (n is an integer equal to or more than 2) or $1:2^1:2^2:\ldots:2^{n-1}$ (n is an integer equal to or more than 1). However, if the number of gradation levels which the sub-pixel can represent decreases, the brightness difference in the sub-pixels becomes large, resulting in the deterioration of picture quality. Also, even if the area of the pixel is made smaller, the large brightness difference causes the conspicuous irregularity in the pixel. Thus, it is desirable not to reduce the number of gradation levels as possible.

Such a configuration makes it possible in the display apparatus according to the second embodiment to prevent the deterioration of picture quality which is peculiar to the area gradation representation method in the case of gradual gradation representation such as a gradation and so on.

Next, a first example in which the display apparatus according to the second embodiment is applied to a liquid crystal display will be described below with reference to FIG.

Figures 8A, 8B:
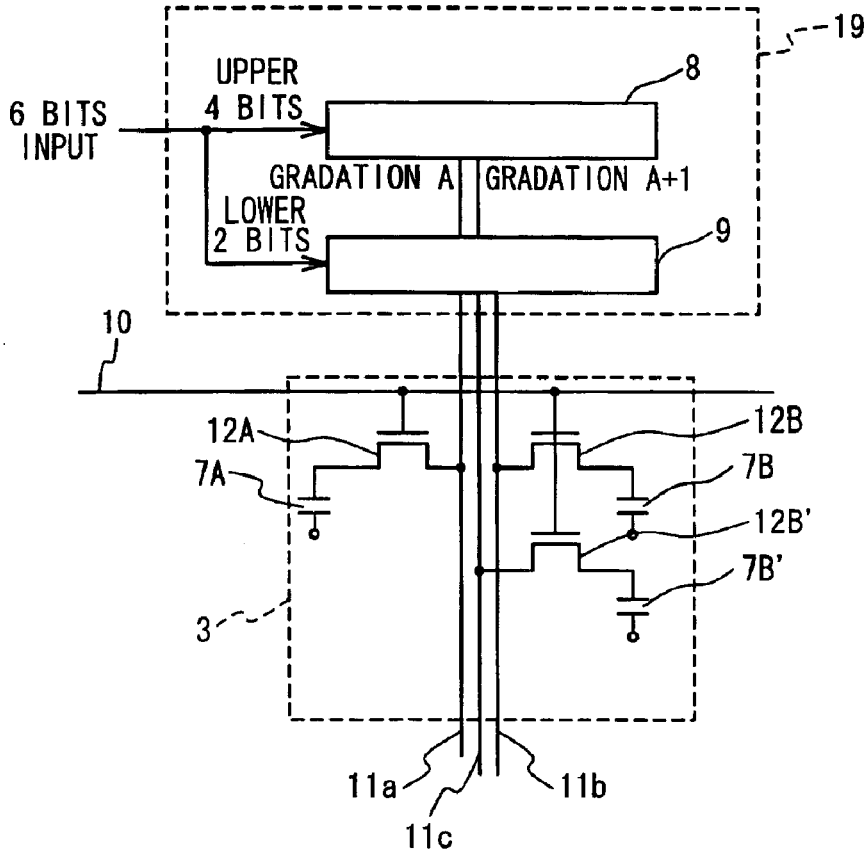
FIG. 8A is a view showing a configuration of the pixel and a source driver of the display apparatus according to the second embodiment.
FIG. 8B is a view showing contents of gradation data outputted by the source driver.

FIG. 8A shows a configuration of a source driver and a pixel of the display apparatus according to the second embodiment. FIG. 8B shows contents of gradation data which the source driver outputs.

The display apparatus according to the second embodiment shown in FIG. 8A is the liquid crystal display in which 6-bit gradation representation is possible due to the combination of a four bit DAC and the area gradation representation method. FIG. 8A shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The sub-pixels 7A, 7B and 7B' correspond to a pixel electrode or a capacitor. For example, a TFT (Thin Film Transistor) 12 as a switching element, is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 8A, the TFTs (Thin Film Transistors) 12A, 12B and 12B', which are switching elements, are provided for one pixel at the intersections of a scanning line 10 corresponding to the scanning line G1 and data lines 11*a*, 11*b* and 11*c* corresponding to the data line S1, respectively. A gate electrode of the TFT 12A is connected to the scanning line 10, a source electrode thereof is connected to the data line 11*a*, and a drain electrode thereof is connected to the sub-pixel 7A which is the pixel electrode. A gate electrode of the TFT 12B is connected to the scanning line 10, a source electrode thereof is connected to the data line 11*b*, and a drain electrode thereof is connected to the sub-pixel 7B which is the pixel electrode. A gate electrode of the TFT 12B' is connected to the scanning line 10, a source electrode thereof is connected to the data line 11*c*, and a drain electrode thereof is connected to the sub-pixel 7B' as the pixel electrode.

Also, the source driver 19 includes a gradation voltage generator 8 and a selector 9 for selecting one of the gradation level A and the gradation level A+1 based on the predetermined bits in a plurality of bits. The upper four bits of the supplied six bits data which are gradation data (input data) corresponding to a data signal are supplied to the gradation voltage generator 8. The gradation voltage generator 8 outputs the gradation level A corresponding to the data and the gradation level A+1 whose level is one level higher than that of the gradation level A (higher in brightness). Thus, the gradation voltage generator 8 generates 17 gradation levels. The selector 9 receives gradation voltages A and A+1 which are generated by the gradation voltage generator 8 using the upper four bits data of the supplied six bits data, determines a gradation voltage to be sent to the data lines 11*a*, 11*b* and 11*c* based on the lower two bits gradation data of the supplied six bits data (namely, selects one of the gradation level A and the gradation level A+1), and then outputs as the data signal. The selector 9 makes a control such that at least one of a first sub-pixel (for example, the sub-pixel 7A or 7B') and a second sub-pixel (for example, the sub-pixel 7B) represents the selected one of the gradation level A and the gradation level A+1.

Next, a method for selecting the gradation voltage in the selector of the first example in which the display apparatus according to the second embodiment is applied to a liquid crystal display will be described below with reference to FIG. 8B.

FIG. 8B shows the method for selecting the outputs to the sub-pixels 7B, 7B'. As shown in FIG. 8B, the selector 9 outputs the gradation level A+1 to the sub-pixel 7A if the first bit of the supplied lower two bits is 1, while outputs the gradation level A+1 to the sub-pixel 7B if the second bit is 1. Thus, the number of necessary selected output is 2. If the supplied lower two bits are "00", the selector 9 outputs the gradation level A to the sub-pixels 7A, 7B and 7B'. If the supplied lower two bits are "01", the selector 9 outputs the gradation level A to the sub-pixel 7A, outputs the gradation level A+1 to the sub-pixel 7B, and outputs the gradation level A to the sub-pixel 7B'. If the supplied lower two bits are "10", the selector 9 outputs the gradation level A+1 to the sub-pixel 7A, and outputs the gradation level A to the sub-pixels 7B and 7B'. If the supplied lower two bits are "11", the selector 9 outputs the gradation level A+1 to the sub-pixels 7A and 7B, and outputs the gradation level A to the sub-pixel 7B'. Here, in the relationship between the output of the sub-pixel and the lower two bits shown in FIG. 8B, the sub-pixel 7B' always outputs the gradation level A, and the sub-pixel 7B outputs the gradation level A+1 if the second bit of the lower bits is 1, and outputs the gradation level A if the second bit is at 0. As described above, the configuration of the selector 9 can be made simple by setting the area ratio of the sub-pixels as 1:1:2. This applies to the case where the area ratio of the sub-pixels is set to $1:1:2^1:2^2: \ldots :2^{n-2}$ (n is an integer equal to or more than 2) as well.

The configuration makes it possible to provide a liquid crystal display capable of 64-gradation-level representation and high-quality area gradation representation in the first example in which the display apparatus according to the second embodiment is applied to a liquid crystal display.

Next, a second example in which the display apparatus according to the second embodiment is applied to a liquid crystal display will be described below with reference to FIG. 9.

Figure 9:
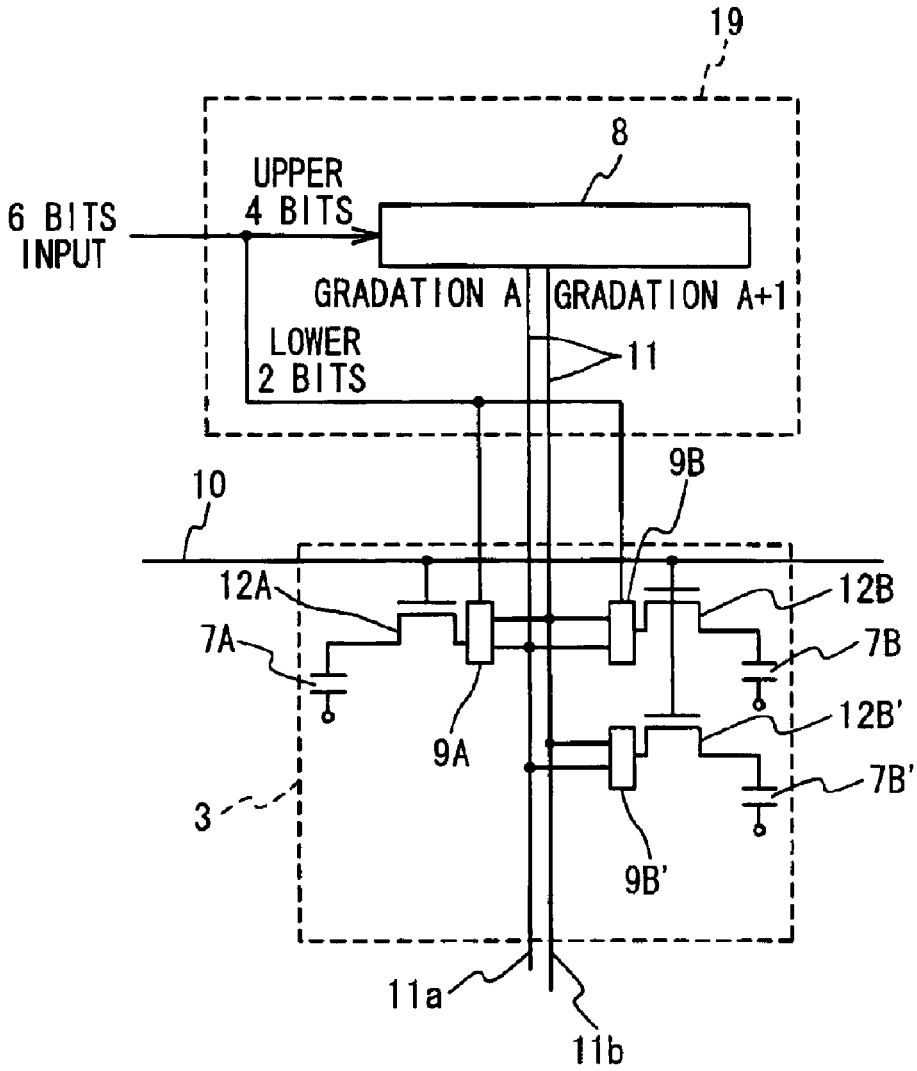
FIG. 9 is a view showing other a configuration of the pixel and the source driver of the display apparatus according to the second embodiment.

FIG. 9 shows another configuration of a source driver and a pixel of the display apparatus according to the second embodiment.

The display apparatus according to the second embodiment shown in FIG. 9 is the liquid crystal display in which six-bit gradation representation is possible due to the combination of a four bit DAC and the area gradation representation method. FIG. 9 shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The difference between the second example and the first example, in which the display apparatus according to the second embodiment is applied to a liquid crystal display, is that in the second example each of selectors 9A and 9B for selecting one of the gradation level A and the gradation level A+1 based on the predetermined bits in a plurality of bits is provided for the corresponding sub-pixel in the pixel 3.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The sub-pixels 7A, 7B and 7B' correspond to a pixel electrode or a capacitor. For example, a TFT (Thin Film Transistor) 12 as a switching element, is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 9, the TFTs (Thin Film Transistors) 12A, 12B and 12B', which are switching elements, are provided for one pixel at the intersections of a scanning line 10 corresponding to the scanning line G1 and data lines 11*a* and 11*b* corresponding to the data line S1, respectively. A gate electrode of the TFT 12A is connected to the scanning line 10, a source electrode thereof is connected to the selector 9A corresponding to the above-mentioned selector 9, and a drain electrode thereof is connected to the sub-pixel 7A which is the pixel electrode. A gate electrode of the TFT 12B is connected to the scanning line 10, a source electrode thereof is connected to the selector 9B corresponding to the above-mentioned selector 9, and a drain electrode thereof is connected to the sub-pixel 7B which is the pixel electrode. A gate electrode of the TFT 12B' is connected to the scanning line 10, a source electrode thereof is connected to the selector 9B' corresponding to the above-mentioned selector 9, and a drain electrode thereof is connected to the sub-pixel 7B' which is the pixel electrode.

Also, the source driver 19 includes a gradation voltage generator 8. The gradation voltage generator 8 connects to the selectors 9A, 9B and 9B' through the data lines 11*a* and 11*b*, and generates gradation voltages A and A+1 (gradation level A+1: a gradation whose level is one level higher than that of gradation level A) by using the upper four bits of the supplied six bits data. Each of the selectors 9A, 9B and 9B' receives the gradation voltage A through the data line 11*a* and the gradation voltage A+1 through the data line 11*b* from the gradation voltage generator 8, determines a gradation voltage to be sent to the TFTs 12A, 12B and 12B' based on the lower two bits gradation data of the supplied six bits data (namely, selects one of the gradation level A and the gradation level A+1), and then outputs as the data signal. The selector 9A makes a control such that the sub-pixel 7A represents the selected one of the gradation level A and the gradation level A+1. Also, the selector 9B makes a control such that the sub-pixel 7B represents the selected one of the gradation level A and the gradation level A+1. Also, the selector 9B' makes a control such that the sub-pixel 7B' represents the selected one of the gradation level A and the gradation level A+1.

The configuration in which the selectors 9A, 9B and 9B' are provided in each pixel can be realized by using polysilicon process and a silicon substrate. The selectors 9A and 9B in FIG. 9 are indispensable in carrying out the first example. If the maximum brightness is desired to increase when representing "White", for example, the selector 9B' enables the selector 9B' to select the gradation level A+1. In addition to the effect provided by the first example, the configuration described above can provide the liquid crystal display having the excellent picture quality in the area gradation representation.

Next, a third example in which the display apparatus according to the second embodiment is applied to a liquid crystal display will be described below with reference to FIGS. 10A, 10B and 10C.

FIG. 10A shows still another configuration of a source driver and a pixel of the display apparatus according to the second embodiment. FIG. 10B shows another configuration. FIG. 10C shows contents which the pixel outputs.

The display apparatus according to the second embodiment shown in FIG. 10A is the liquid crystal display in which six-bit gradation representation is possible due to the combination of a four bit DAC and the area gradation representation method. FIG. 10A shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The difference between the third example and the second example, in which the display apparatus according to the second embodiment is applied to a liquid crystal display, is in that in the third example an input signal interchange unit 15 for rearranging the supplied six bits data and a memory 13 of two bits are provided for each pixel, and a calculator 14 is provided one step before the input of a selected signal to one selector in the sub-pixel 7B having a smaller area.

The sub-pixels 7A, 7B and 7B' correspond to a pixel electrode or a capacitor. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 10A, the TFTs (Thin Film Transistors) 12A, 12B and 12B' as switching elements are provided for one pixel at the intersections of a scanning line 10 corresponding to the scanning line G1 and data lines 11*a* and 11*b* corresponding to the data line S1, respectively. A gate electrode of the TFT 12A is connected to the scanning line 10, a source electrode thereof is connected to the selector 9A corresponding to the above-mentioned selector 9, and a drain electrode thereof is connected to the sub-pixel 7A as the pixel electrode. A gate electrode of the TFT 12B is connected to the scanning line 10, a source electrode thereof is connected to the selector 9B corresponding to the above-mentioned selector 9, and a drain electrode thereof is connected to the sub-pixel 7B which is the pixel electrode.

A gate electrode of the TFT 12B' is connected to the scanning line 10, a source electrode thereof is connected to the selector 9B' corresponding to the above-mentioned selector 9, and a drain electrode thereof is connected to the sub-pixel 7B' as the pixel electrode. Also, the calculator 14 is provided at the input section of the selectors 9A, 9B and 9B'.

Also, the source driver 19 includes an input signal interchange unit 15 which interchanges the predetermined upper four bits and the predetermined lower two bits of the six bits included in the data signal, a gradation voltage generator 8, and a memory 13 which stores a plurality of bits. The gradation voltage generator 8 connects to the selectors 9A, 9B and 9B' through the data lines 11*a* and 11*b*. The input signal interchange unit 15 receives the supplied six bits data which is the gradation data (input data) corresponding to the data signal, and selects whether it outputs the lower four bits of the supplied six bits to the gradation voltage generator 8 and outputs the upper two bits of the supplied six bits to the two memories 13 or outputs the upper four bits to the gradation voltage generator 8 and outputs the lower two bits to the two memories 13. Each of the selectors 9A, 9B and 9B' receives the gradation voltages A and A+1 (gradation level A+1: a gradation whose level is one level higher than that of gradation level A) generated by the gradation voltage generator 8 using the upper four bits of the data, determines a gradation voltage to be sent to the TFT 12 based on the lower two bits gradation data outputted from the input signal interchange unit 15 (namely, selects one of the gradation level A and the gradation level A+1), and then outputs as the data signal. Or, the input signal interchange unit 15 interchanges the signal such that the upper two bits are stored in the memory 13, and the calculator 14 outputs the sum of product of the two inputs, which makes 4-gradation-level representation possible. The selector 9A makes a control such that the sub-pixel 7A represents the selected one of the gradation level A and the gradation level A+1. Also, the selector 9B makes a control such that the sub-pixel 7B represents the selected one of the gradation level A and the gradation level A+1. Also, the selector 9B' makes a control such that the sub-pixel 7B' represents the selected one of the gradation level A and the gradation level A+1. The calculator 14 receives the bit stored in the memory 13, and outputs a result to the selector 9B' that is not connected to the memory 13. It should be noted that while the memory 13 is provided outside the pixel 3, the same effect can be obtained even if the memory 13 is provided within the pixel 3.

As described above, it is possible in the third example shown in FIG. 10A to provide two modes in terms of the operational mode. According to the third example, in a usual multiple-gradation mode (referred to as a first mode), the calculator 14 outputs such that the selector 9B' selects a gradation used at the time other than "White" representation, and the other sections operate similarly to the second example. Another mode (referred to as a second mode) is for a static image. In case of the static image, since the same data is used for specifying the gradation of the pixel, gradation representation is carried out by using the memory 13. More specifically, in the static image mode, the input signal interchange unit 15 interchanges the signal such that the upper two bits are stored in the memory 13. The source driver 19 makes a control so that one of the first mode and the second mode is selected. In the first mode, at least one of the sub-pixels 7A, 7B and 7B' represents one of the gradation level A and the gradation level A+1 based on a plurality of bits of the input data (digital signal). In the second mode, 4-gradation-level representation is carried out based on the bits stored in the memory.

The output of the pixel (the second mode) in the third example in which the display apparatus according to the second embodiment is applied to the liquid crystal display will be described below with reference to FIG. 10C.

FIG. 10C shows the contents outputted by the pixel. In the calculator 14, the product sum of the inputs is outputted to enable 4-gradation-level representation. For example, the gradation level A is assumed to be "Black (0)", and the gradation level A+1 is assumed to be "White (1)". As shown in FIG. 10C, if the supplied lower two bits are "00", the selector 9A outputs the gradation level A as "Black (0)" to the sub-pixel 7A, the selector 9B outputs the gradation level A as "Black (0)" to the sub-pixel 7B, and the selector 9B' outputs the gradation level A as "Black (0)" to the sub-pixel 7B'. In this case, the calculator 14 calculates as $(2\times0+1\times0+1\times0)/4=0$, and hence the pixel 3 outputs "Black". If the supplied lower two bits are "01", the selector 9A outputs the gradation level A as "Black (0)" to the sub-pixel 7A, the selector 9B outputs the gradation level A+1 as "White (1)" to the sub-pixel 7B, and the selector 9B' outputs the gradation level A as "Black (0)" to the sub-pixel 7B'. In this case, the calculator 14 calculates as $(2\times0+1\times1+1\times0)/4=1/4$, and hence the pixel 3 outputs a color lighter than "Black". If the supplied lower two bits are "10", the selector 9A outputs the gradation level A+1 as "White (1)" to the sub-pixel 7A, the selector 9B outputs the gradation level A as "Black (0)" to the sub-pixel 7B, and the selector 9B' outputs the gradation level A as "Black (0)" to the sub-pixel 7B'. In this case, the calculator 14 calculates as $(2\times1+1\times0+1\times0)/4=2/4$, and hence the pixel 3 outputs an intermediate color between "Black" and "White". If the input lower two bits are "11", the selector 9A outputs the gradation level A+1 as "White (1)" to the sub-pixel 7A, the selector 9B outputs the gradation level A+1 as "White (1)" to the sub-pixel 7B, and the selector 9B' outputs the gradation level A+1 as "White (1)" to the sub-pixel 7B". In this case, the calculator 14 calculates as $(2\times1+1\times0+1\times1)/4=1$, and hence the pixel 3 outputs "White". Thus, the pixel 3 represents the four gradation levels shown in FIG. 10C.

In this way, in the calculator 14, the product sum of the inputs is outputted to thereby enable 4-gradation-level representation. Although picture quality decreases because a plurality of gradation levels are not used, this mode has an advantage that electric power consumption is suppressed. In other words, it is possible in the configuration to switch between a priority for picture quality or a priority for electric power consumption depending on the usage. Also, the memory 13 is provided with a memory of one bit for each sub-pixel in the third example. When the memory is designed to include multiple bits, picture quality can be made high and electric power consumption can be suppressed in spite of a slight cost increase. The configuration mentioned above makes it possible to provide a liquid crystal display in which picture quality and electric power consumption are balanced in the area gradation representation method.

The same effect can be obtained when a selector 17 including the above-mentioned calculator 14 is provided outside the pixel 3 as shown in FIG. 10B and one memory 13 is provided one step before the input of the control signal, even if the selector is not installed within the pixel. In this case, the liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2 . . . , and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The sub-pixels 7A, 7B and 7B' correspond to pixel electrodes or capacitors. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 10B, the TFTs (Thin Film Transistors) 12A, 12B and 12B' as switching elements are provided for one pixel at the intersections of a scanning line 10 corresponding to the scanning line GC and data lines 11*a*, 11*b* and 11*c* corresponding to the data line S1, respectively. A gate electrode of the TFT 12A is connected to the scanning line 10, a source electrode thereof is connected to the data line 11*a*, and a drain electrode thereof is connected to the sub-pixel 7A as the pixel electrode. A gate electrode of the TFT 12B is connected to the scanning line 10, a source electrode thereof is connected to the data line 11*b*, and a drain electrode thereof is connected to the sub-pixel 7B as the pixel electrode. A gate electrode of the TFT 12B' is connected to the scanning line 10, a source electrode thereof is connected to the data line 11*c*, and a drain electrode thereof is connected to the sub-pixel 7B' as the pixel electrode. Also, the source driver 19 includes an input signal interchange unit 15 which interchanges the predetermined upper four bits and the predetermined lower two bits of the six bits included in the data signal, a gradation voltage generator 8, a memory 13 which stores a plurality of bits, and a selector 17 which selects one of the gradation level A and the gradation level A+1 based on the predetermined bits of the plurality of bits. The input signal interchange unit 15 receives the input six bits data which is the gradation data (input data) corresponding to the data signal, and selects whether it outputs the lower four bits of the supplied six bits to the gradation voltage generator 8 and outputs the upper two bits to the memory 13 or it outputs the upper four bits to the gradation voltage generator 8 and outputs the lower two bits to the memory 13. The selector 17 receives the gradation voltages A and A+1 (gradation level A+1: a gradation whose level is one level higher than that of gradation level A) generated by the gradation voltage generator 8 using the upper four bits of the data, determines a gradation voltage to be sent to the data lines 11*a*, 11*b* and 11*c* based on the lower two bits gradation data outputted from the input signal interchange unit 15 (namely, selects one of the gradation level A and the gradation level A+1), and then outputs as the data signal. Or, the input signal interchange unit 15 interchanges the signal such that the upper two bits are stored in the memory 13, which makes 4-gradation-level representation possible. The selector 17 makes a control such that at least one of a first sub-pixel (for example, the sub-pixel 7A or 7B') and a second sub-pixel (for example, the sub-pixel 7B) represents the selected one of the gradation level A and the gradation level A+1.

The configuration shown in FIG. 10B has an advantage in that the configuration can be applied to an amorphous silicon circuit in which it is difficult to form a semiconductor circuit in a pixel.

Next, a fourth example in which the display apparatus according to the second embodiment is applied to a liquid crystal display will be described below with reference to FIG. 11.

Figure 11:
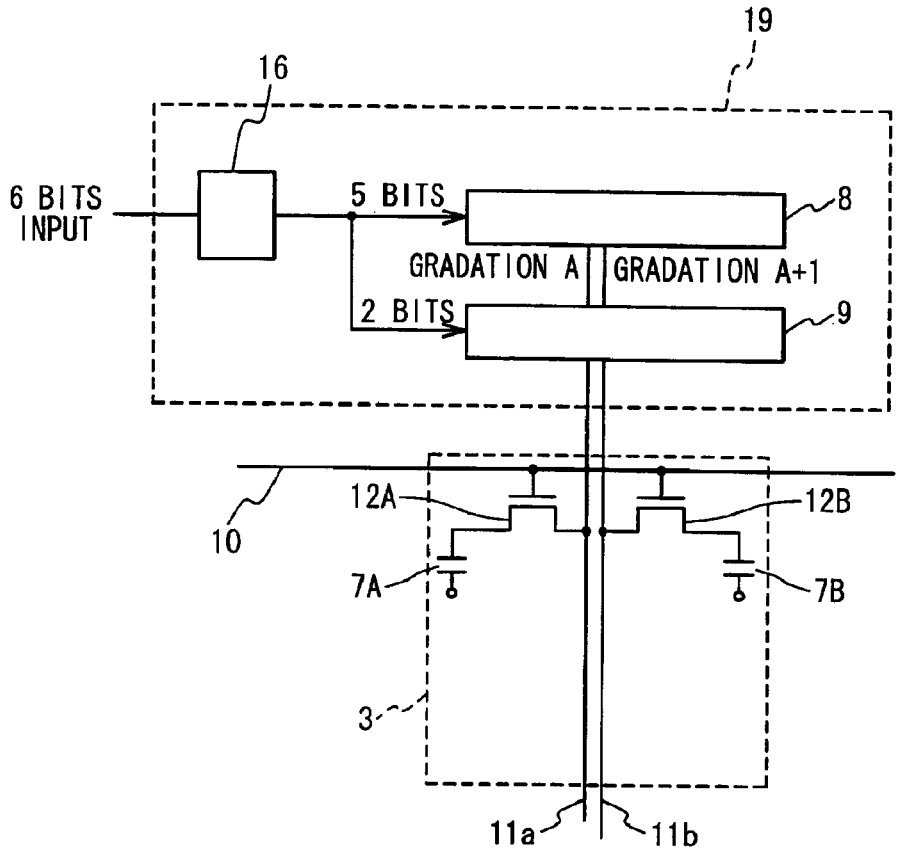
FIG. 11 is a view showing still another configuration of the pixel and the source driver of the display apparatus according to the second embodiment.

FIG. 11 shows still another configuration of a source driver and a pixel of the display apparatus according to the second embodiment.

The display apparatus according to the second embodiment shown in FIG. 11 is the liquid crystal display in which six-bit gradation representation is possible due to the combination of a DAC for bits less than six bits and the area gradation representation method. FIG. 11 shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of two sub-pixels 7A and 7B. In this case, the sub-pixel 7A corresponds to the sub-pixel 7D mentioned above, and the sub-pixel 7B corresponds to the sub-pixel 7C mentioned above. It should be noted that an area ratio of the sub-pixel 7A to the sub-pixel 7B is 2:1. Thus, the pixel 3 includes a total of two sub-pixels, in which the area ratio is 1:2.

The difference between the fourth example and the first example, in which the display apparatus according to the second embodiment is applied to a liquid crystal display, is in that in the fourth example an input signal converting unit 16 is provided which converts the supplied six bits data (data signal) to a five bit gradation signal and a two bit signal for selector, and the sub-pixel consists of the sub-pixel 7A and the sub-pixel 7B, in which the area ratio is 2:1.

The sub-pixels 7A and 7B correspond to pixel electrodes or capacitors. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode. As shown in FIG. 11, the TFTs (Thin Film Transistors) 12A and 12B as switching elements are provided for one pixel at the intersections of a scanning line 10 corresponding to the scanning line G1 and data lines 11*a* and 11*b* corresponding to the data line S1, respectively. A gate electrode of the TFT 12A is connected to the scanning line 10, a source electrode thereof is connected to the data line 11*a*, and a drain electrode thereof is connected to the sub-pixel 7A as the pixel electrode. A gate electrode of the TFT 12B is connected to the scanning line 10, a source electrode thereof is connected to the data line 11*b*, and a drain electrode thereof is connected to the sub-pixel 7B as the pixel electrode.

Also, the source driver 19 includes an input signal converting unit 16, a gradation voltage generator 8, and a selector 9 for selecting one of the gradation level A and the gradation level A+1 based on the predetermined bits in a plurality of bits. The selector 9 is connected through each data line 11 to the source electrode of the TFT 12. The input signal converting unit 16 receives the supplied six bits gradation data (input data) corresponding to the data signal, and outputs five bits in the supplied six bits operated by the input signal converting unit 16 to the gradation voltage generator 8, and outputs two bits in the supplied six bits operated by the input signal converting unit 16 to the selector 9. The selector 9 receives gradation voltages A and A+1 (gradation level A+1: a gradation whose level is one level higher than that of gradation level A) which are generated by the gradation voltage generator 8 using the five bits data, determines a gradation voltage to be sent to the data lines 11*a* and 11*b* based on the upper two bits gradation data outputted from the input signal converting unit 16 (namely, selects one of the gradation level A and the gradation level A+1), and then outputs as the data signal. The selector 9 makes a control such that at least one of the sub-pixel 7A the sub-pixel 7B represents the selected one of the gradation level A and the gradation level A+1.

In the case where the number of the sub-pixels is 2 and the area ratio is 2:1, gradation voltages corresponding to 22 gradation levels (because 64/3=21.333 . . . ) are necessary in order to present 64-gradation-level representation. This signal generation process, in which a gradation signal includes five bits at the input signal converting unit 16, is configured such that the input signal converting unit 16 inputs a quotient obtained by dividing the gradation signal by three to the gradation voltage generator 8, and supplies the residual to the selector 9. Each of the gradation level A and the gradation level A+1 generated by the gradation voltage generator 8 is supplied to the selector 9. If the first bit of the two bit data as the residual mentioned above is 1, the gradation level of the sub-pixel 7A is set to A+1, and if the second bit is 1, the gradation level of the sub-pixel 7B is set to A+1, and the gradation level A is set in other cases. Thus, 64-gradation-level representation is attained. As described above, it is possible to provide a liquid crystal display for area gradation representation with high picture quality, although the signal generation is slightly complex.

Next, a fifth example in which the display apparatus according to the second embodiment is applied to a liquid crystal display will be described below with reference to FIGS. 12A and 12B.

Figures 12A, 12B:
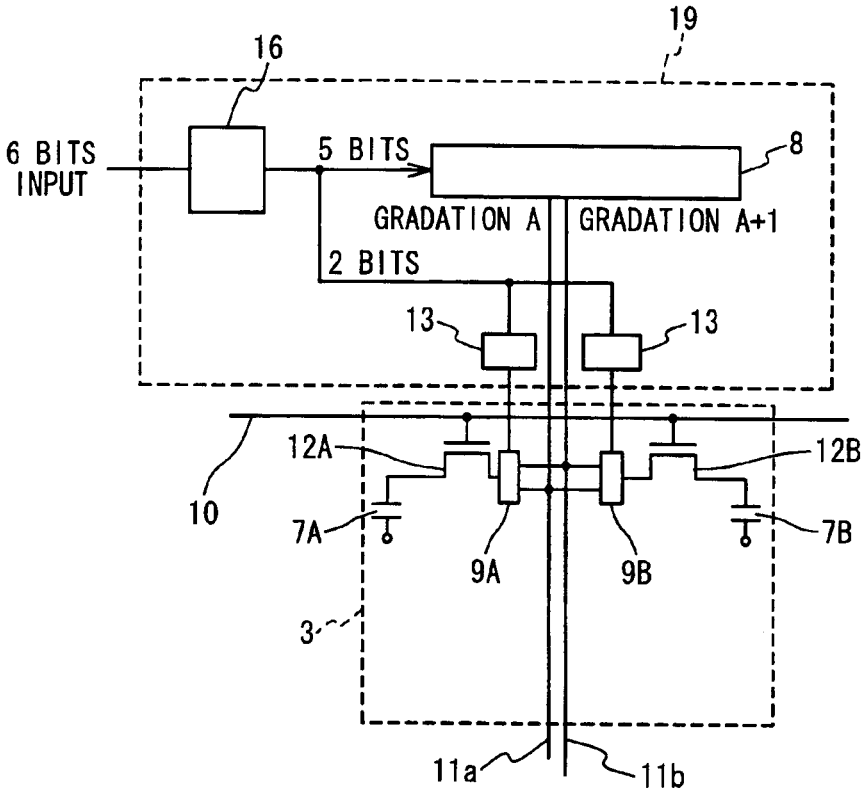
FIG. 12A is a view showing still another configuration of the pixel and the source driver of the display apparatus according to the second embodiment.
FIG. 12B is a view showing contents which the pixel represents.

FIG. 12A shows still another configuration of a source driver and a pixel of the display apparatus according to the second embodiment. FIG. 12B shows contents which the pixel outputs.

The display apparatus according to the second embodiment shown in FIG. 12A is the liquid crystal display in which six-bit gradation representation is possible due to the combination of a DAC for bits less than six bits and the area gradation representation method. FIG. 12A shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the supplied data to the source driver 19. More specifically, if the number of bits of the supplied gradation data is eight, ten and the like, and is different from 6, the control unit 5 converts the gradation data into six bits data, and outputs the digital signal as the input data (data signal) to the source driver 19.

The pixel 3 of the liquid crystal display is composed of two sub-pixels 7A and 7B. In this case, the sub-pixel 7A corresponds to the sub-pixel 7D mentioned above, and the sub-pixel 7B corresponds to the sub-pixel 7C mentioned above. It should be noted that an area ratio of the sub-pixel 7A to the sub-pixel 7B is 2:1. Thus, the pixel 3 includes a total of two sub-pixels, in which the area ratio is 1:2.

The difference between the fifth example and the fourth example, in which the display apparatus according to the second embodiment is applied to a liquid crystal display, is in that in the fourth example a memory 13 of one bit is provided one step before the selectors 9A and 9B which select one of the gradation level A and the gradation level A+1 based on the predetermined bits of a plurality of bits.

The sub-pixels 7A and 7B correspond to pixel electrodes or capacitors. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode. As shown in FIG. 12A, the TFTs (Thin Film Transistors) 12A and 12B as switching elements are provided for one pixel at the intersections of a scanning line 10 corresponding to the scanning line G1 and data lines 11*a* and 11*b* corresponding to the data line S1, respectively. A gate electrode of the TFT 12A is connected to the scanning line 10, a source electrode thereof is connected to the data line 11*a*, and a drain electrode thereof is connected to the sub-pixel 7A which is the pixel electrode. A gate electrode of the TFT 12B is connected to the scanning line 10, a source electrode thereof is connected to the data line 11*b*, and a drain electrode thereof is connected to the sub-pixel 7B as the pixel electrode.

Also, the source driver 19 includes an input signal converting unit 16, a gradation voltage generator 8, and a memory 13 storing a plurality of bits. The input signal converting unit 16 receives the supplied six bits gradation data (supplied data) corresponding to the data signal, and outputs five bits in the supplied six bits operated by the input signal converting unit 16 to the gradation voltage generator 8, and outputs two bits in the supplied six bits operated by the input signal converting unit 16 to the two memories 13. Each of the selectors 9A and 9B receives the gradation voltages A and A+1 (gradation level A+1: a gradation whose level is one level higher than that of gradation level A) generated by the gradation voltage generator 8 using the five bits data, determines a gradation voltage to be sent to the TFT (Thin Film Transistor) 12 based on the two bits gradation data outputted from the input signal converting unit 16 (namely, selects one of the gradation level A and the gradation level A+1), and then outputs as the data signal. Or, the input signal converting unit 16 converts the signal such that the upper two bits are stored in the memory 13, to allow 4-gradation-level representation. The selector 9A makes a control such that the sub-pixel 7A represents the selected one of the gradation level A and the gradation level A+1. Also, the selector 9B makes a control such that the sub-pixel 7B represents the selected one of the gradation level A and the gradation level A+1. It should be noted that while the selectors 9A and 9B are provided within the pixel 3 according to the fifth example shown in FIG. 12A, the selectors 9A and 9B can be provided outside the pixel 3 and the memory can be provided one step before them, as is similar to FIG. 10B.

As described above, it is possible in the fifth example shown in FIG. 12A to provide two modes in terms of the operational mode, as is similar to the third example. That is, in a usual multiple-gradation mode (referred to as a first mode), a similar operation as is in the fourth example are carried out. Another mode (referred to as a second mode) is for a static image. In case of the static image, since the same data is used for writing the gradation of the pixel, gradation representation is carried out by using the memory 13. In the static image mode, the input signal converting unit 16 operates such that the upper two bits are stored in the memory 13. The source driver 19 makes a control so that one of the first mode and the second mode is selected. In the first mode, at least one of the sub-pixels 7A and 7B represents one of the gradation level A and the gradation level A+1 based on a plurality of bits of the input data (digital signal). In the second mode, 4-gradation-level representation is presented based on the bits stored in the memory.

The output of the pixel (the second mode) in the fifth example, in which the display apparatus according to the second embodiment is applied to the liquid crystal display, will be described below with reference to FIG. 12B.

FIG. 12B shows the contents outputted by the pixel. For example, the gradation level A is assumed to be "Black (0)", and the gradation level A+1 is assumed to be "White (1)". As shown in FIG. 12B, if the supplied upper two bits are "00", the selector 9A outputs the gradation level A as "Black (0)" to the sub-pixel 7A, and the selector 9B outputs the gradation level A as "Black (0)" to the sub-pixel 7B. In this case, the result is $(2\times0+1\times0/3)=0$, and hence the pixel 3 outputs "Black". If the supplied upper two bits are "01", the selector 9A outputs the gradation level A as "Black (0)" to the sub-pixel 7A, and the selector 9B outputs the gradation level A+1 as "White (1)" to the sub-pixel 7B. In this case, the result is $(2\times0+1\times1)/3=1/3$, and hence the pixel 3 outputs a color lighter than "Black". If the supplied upper two bits are "10", the selector 9A outputs the gradation level A+1 as "White (1)" to the sub-pixel 7A, and the selector 9B outputs the gradation level A as "Black (0)" to the sub-pixel 7B. In this case, the result is $(2\times1+1\times0)/3=2/3$, and hence the pixel 3 outputs a color further lighter than "Black". If the input upper two bits are "11", the selector 9A outputs the gradation level A+1 as "White (1)" to the sub-pixel 7A, and the selector 9B outputs the gradation level A+1 as "White (1)" to the sub-pixel 7B. In this case, the result is $(2\times1+1\times1)/3=1$, and hence the pixel 3 outputs "White". Thus, the pixel 3 represents the four gradation levels shown in FIG. 12B.

Since this configuration suppress electric power consumption as is similar to the third example, it is possible to switch between a priority for picture quality or a priority for electric power consumption depending on the usage. Moreover, when the memory is designed to include multiple bits, picture quality can be made high and electric power consumption can be suppressed, though the configuration becomes slightly complex. The configuration mentioned above makes it possible to provide a liquid crystal display in which picture quality and electric power consumption are balanced in the area gradation representation method.

It is desirable in the area gradation representation method that the resolution is as fine as possible so that distinction between the sub-pixels adjacent to each other is impossible. Also, the higher resolution than that of a human eye is desirable in order to suppress a periodical pattern resulting from the arrangement of the sub-pixels. For the practical usage, the resolution is desired to be more than twice as much as the resolution of a current panel for normal gradation representation. For example, since the resolution of a current 15-inch diagonal XGA (1024×768) display panel is about 85 ppi (pixel/inch), the display apparatus with the resolution of 170 ppi or more is desirable. This is not the case, however, when multiple-gradation representation of the sub-pixel is enough fine, even if the resolution of the display apparatus is lower than the above value.

It should be noted that devices such as an MIM, a diode and the like, can be used as the switching element, though the TFT is used in the above-mentioned examples. Moreover, in those configurations, the gradation levels adjacent to each other are used as the two gradation levels to be selected. However, the gradation levels close to each other may be used although the configurations become slightly complex.

Also, the gradation voltage generator 8, the selector 9 (including 9A, 9B and 9B'), the memory 13, the calculator 14, the input signal interchange unit 15, the input signal converting unit 16 (including 16A), the selector 17 and the gradation voltage generator 18 are installed in the source driver 19. However, they may be installed in the control unit 5.

Such a configuration makes it possible to provide a liquid crystal display capable of 64-gradation-level representation and high-quality area gradation.

Moreover, in this example of the display apparatus according to the second embodiment, the liquid crystal display is used as the display apparatus. In addition to that, the display apparatus can be applied to another display apparatus that can present more than two gradation levels. For example, the display apparatus can be applied to an organic EL (Electric Luminescence) device in which six-bit gradation representation is difficult by the normal gradation representation method.

As described above, the display apparatus according to the second embodiment can achieve area gradation representation with high picture quality and 64-gradation representation.

A display apparatus according to a third embodiment will be described below with reference to FIGS. 13A and 13B, in which the number of possible gradation levels is increased in order to reduce brightness difference between sub-pixels by temporally changing the gradation level which the sub-pixel presents every frame. It should be noted that the configuration of the display apparatus in the third embodiment is similar to that in the first embodiment, and the explanation is omitted.

Figure 13A:
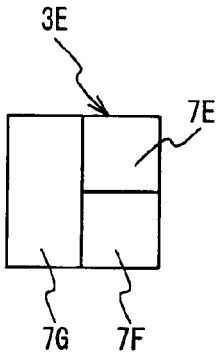
FIG. 13A is a view showing a configuration of a pixel in a display panel of a display apparatus according to a third embodiment.
Figure 13B:
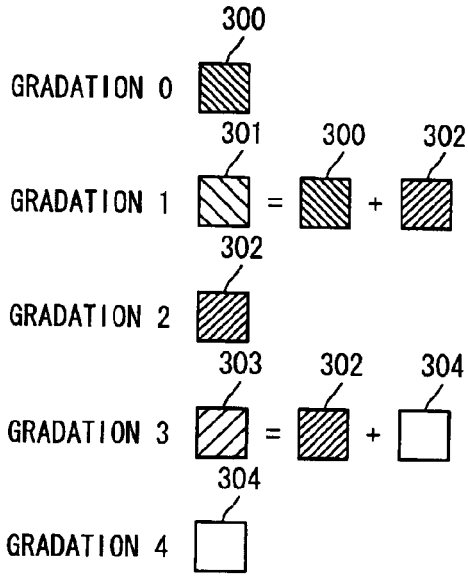
FIG. 13B is a view showing gradation representation with the pixel shown in FIG. 13A.

FIG. 13A shows a configuration of a pixel in a display panel of the display apparatus according to the third embodiment, and FIG. 13B shows gradation representation using the pixel shown in FIG. 13A.

As shown in FIG. 13A, a numeral 3E indicates a pixel corresponding to the pixel 3 of the display panel 4. The pixel 3E is composed of sub-pixels 7E, 7F and 7G which are adjacent to each other, and an area ratio between the sub-pixels 7E, 7F and 7G is 1:1:2. Here, if the number of gradation levels which each sub-pixel can normally present is three and the number of frame division is two, for example, the number of gradation levels according to the configuration of the pixel 3E is five as shown in FIG. 13B. In this case, a numeral 300 indicates a gradation level 0 (for example, black), a numeral 301 indicates a gradation level 1, a numeral 302 indicates a gradation level 2, a numeral 303 indicates a gradation level 3, and a numeral 304 indicates a gradation level 4 (for example, white). Thus, 5-gradation-level representation is possible. Also, as a gradation level shifts from the gradation level 0 to the gradation level 4, the color becomes gradually lighter from "Black" to "White" as shown in FIG. 13B. The gradation level 1 indicated by the numeral 301 is obtained by representing the gradation level 0 indicated by the numeral 300 for one frame and representing the gradation level 2 indicated by the numeral 302 for one frame. The gradation level 3 indicated by the numeral 303 is obtained by representing the gradation level 2 indicated by the numeral 302 for one frame and representing the gradation level 4 indicated by the numeral 304 for one frame. As described above, high-quality area gradation representation is possible with the further little number of usual gradation levels by involving the time division representation method.

In the display apparatus according to the third embodiment mentioned above as shown in FIG. 13A, the area ratio of the sub-pixels in the pixel is 1:1:2 and the number of frames is two. The number of the sub-pixels can be further increased. In that case, multiple-gradation representation is possible in the display apparatus according to the above-mentioned third embodiment by dividing n sub-pixels with an area ratio of $1:1:2^1:2^2: \ldots :2^{n-2}$ (n is an integer equal to or more than 2). However, even when the area of the pixel is made small, irregularity in the pixel becomes conspicuous if the brightness difference is large. Therefore, it is desirable that the area ratio of a maximum pixel to a minimum pixel is lower than four. Moreover, while the number of the frames is two, it can be increased to the extent that a flicker is invisible. The number of frames is practically desired to be equal to or less than four, considering that a refresh rate is 60 Hz and 10–15 images is displayed for one second as a motion picture.

Such a configuration makes it possible to provide a display apparatus without deterioration of picture quality which is peculiar to the area gradation representation method in the case of gradual gradation representation such as a gradation and so on.

Furthermore, the closer the gradation levels to be selected in the pixel are, the simpler the signal selection in the actual operation becomes. Therefore, it is desirable that the number of gradation levels to be used in each pixel is two. Moreover, in order to reduce the brightness difference as much as possible, the two gradation levels to be selected are desired to be two gradation levels adjacent to each other.

Next, a first example in which the display apparatus according to the third embodiment is applied to a liquid crystal display will be described below with reference to FIGS. 14A and 14B.

Figures 14A, 14B:
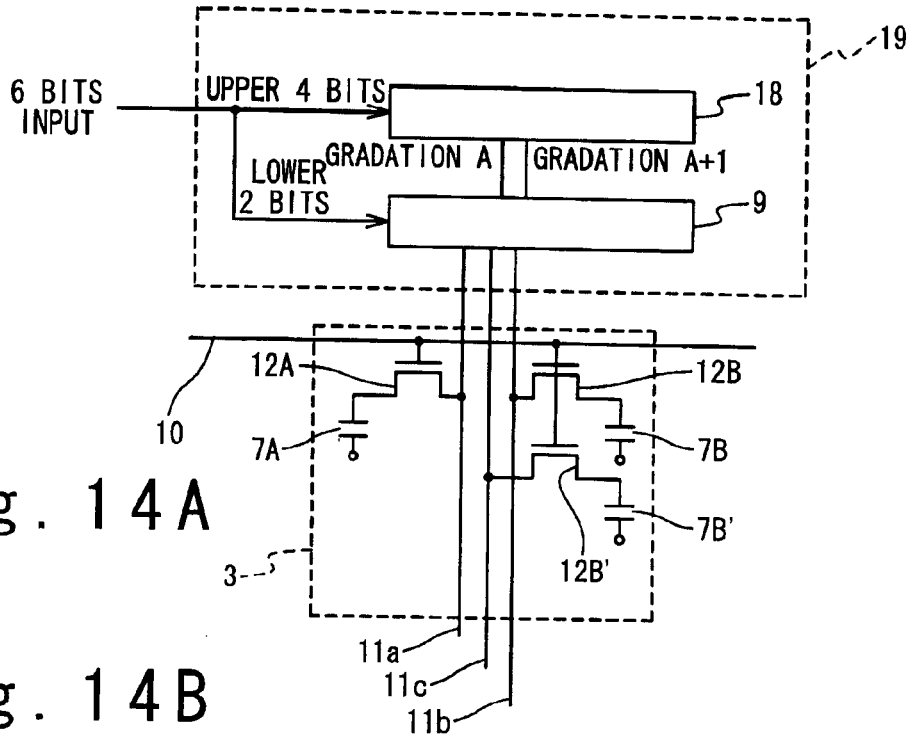
FIG. 14A is a view showing a configuration of the pixel and a source driver of the display apparatus according to the third embodiment.
FIG. 14B is a view showing gradation voltages.

FIG. 14A shows a configuration of a source driver and a pixel of the display apparatus according to the third embodiment. FIG. 14B shows gradation voltages.

The display apparatus according to the third embodiment shown in FIG. 14A is the liquid crystal display in which six-bit gradation representation is possible due to the combination of a 9-bit DAC and the area gradation representation method. FIG. 14A shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The difference between the third embodiment and the second embodiment, in which the display apparatus is applied to a liquid crystal display, is in that the gradation voltage generator 8 is changed to a gradation voltage generator 18 which can change the gradation voltage temporally. The pixel 3 of the liquid crystal display is composed of three sub-pixels including one sub-pixel 7A and two sub-pixels 7B. In this case, the one sub-pixel 7A corresponds to the sub-pixel 7G mentioned above, and the two sub-pixels 7B correspond to the sub-pixels 7E and 7F mentioned above.

The sub-pixels 7A, 7B and 7B' correspond to pixel electrodes or capacitors. For example, a TFT (Thin Film Transistor) 12 as a switching element, is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 14A, the TFTs (Thin Film Transistors) 12A, 12B and 12B' as switching elements are provided for one pixel at the intersections of a scanning line 10 corresponding to the scanning line G1 and data lines 11*a*, 11*b* and 11*c* corresponding to the data line S1, respectively. A gate electrode of the TFT 12A is connected to the scanning line 10, a source electrode thereof is connected to the data line 11*a*, and a drain electrode thereof is connected to the sub-pixel 7A as the pixel electrode. A gate electrode of the TFT 12B is connected to the scanning line 10, a source electrode thereof is connected to the data line 11*b*, and a drain electrode thereof is connected to the sub-pixel 7B as the pixel electrode. A gate electrode of the TFT 12B' is connected to the scanning line 10, a source electrode thereof is connected to the data line 11*c*, and a drain electrode thereof is connected to the sub-pixel 7B' as the pixel electrode.

Also, the source driver 19 includes a gradation voltage generator 18 capable of changing the gradation voltage temporally, and a selector 9 for selecting one of the gradation level A and the gradation level A+1 based on the predetermined bits in a plurality of bits. The upper four bits of the supplied six bits data which are gradation data (input data) corresponding to a data signal are supplied to the gradation voltage generator 18. Here, if two frames are used to represent one gradation level, nine gradation voltages are necessary. The gradation levels A and A+1 are as shown in FIG. 14B. As can be understood from FIG. 14B, the gradation level A and the gradation level A+1 have the same output in a ½ frame for a certain input of upper four bits, in which the output value is obtained by adding a value of the lower one bit to a value of the upper three bits (for example, a value "4" is obtained by adding a decimal value "1" for the lower one bit "1" of the supplied upper four bits "0011" is added to a decimal value "3" for the upper three bits "011" of the supplied upper four bits "0111". On the other hand, in a 2/2 frame, the gradation level A has the output value of the upper three bits, and the gradation level A+1 has the output value obtained by adding 1 to the value of the upper three bits. It can be understood that such configuration enables 17-gradation-level output in the time average. Thus, 64-gradation-level representation is possible in the following step through the same operations as in FIGS. 8A and 8B.

The gradation voltage generator 18 outputs the gradation level A corresponding to the data and the gradation level A+1 whose level is one level higher than that of the gradation level A (higher in brightness). The selector 9 receives the lower two bits of the supplied six bits which is the gradation data (input data) corresponding to the data signal, and the gradation voltages A and A+1 which are generated by the gradation voltage generator 18 using the upper four bits data of the supplied six bits data. Then, the selector 9 determines a gradation voltage to be sent to the data lines 11*a*, 11*b* and 11*c* based on the lower two bits gradation data of the supplied six bits data (namely, selects one of the gradation level A and the gradation level A+1), and then outputs as the data signal. The selector 9 makes a control such that at least one of a first sub-pixel (for example, the sub-pixel 7A or 7B') and a second sub-pixel (for example, the sub-pixel 7B) represents the selected one of the gradation level A and the gradation level A+1.

In the first example of the display apparatus according to the third embodiment, the gradation voltage generator 18 changes the gradation voltage in each frame time. The above-mentioned first example can be realized by changing the former input data for each frame.

Next, a second example in which the display apparatus according to the third embodiment is applied to a liquid crystal display will be described below with reference to FIG. 15.

Figure 15:
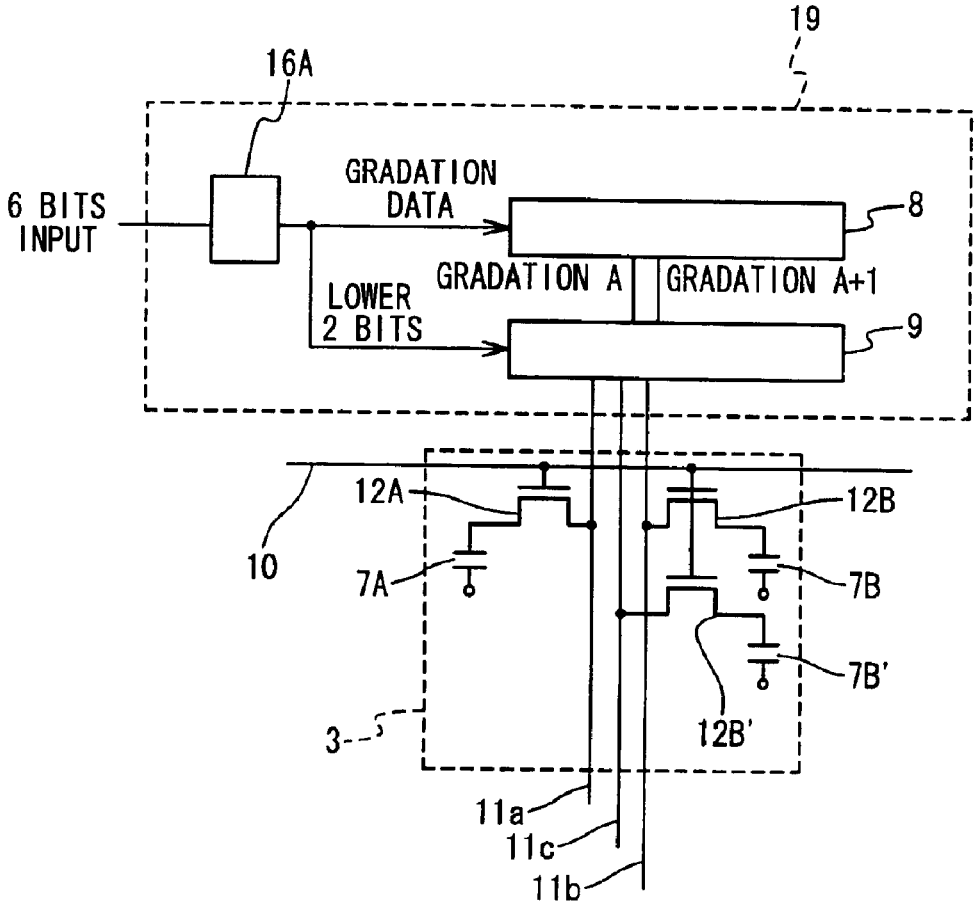
FIG. 15 is a view showing another configuration of the pixel and the source driver of the display apparatus according to the third embodiment.

FIG. 15 shows another configuration of a source driver and a pixel of the display apparatus according to the third embodiment.

The display apparatus according to the third embodiment shown in FIG. 15 is the liquid crystal display in which six-bit gradation representation is possible due to the combination of a 9-bit DAC and the area gradation representation method. FIG. 15 shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The difference between the second example and the first example, in which the display apparatus according to the third embodiment is applied to a liquid crystal display, is in that in the second example an input signal converting unit 16A is provided one step before the data input to the gradation voltage generator 8.

The sub-pixels 7A, 7B and 7B' correspond to pixel electrodes or capacitors. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 15, the TFTs (Thin Film Transistors) 12A, 12B and 12B' as switching elements are provided for one pixel at the intersections of a scanning line 10 corresponding to the scanning line G1 and data lines 11*a*, 11*b* and 11*c* corresponding to the data line S1, respectively. A gate electrode of the TFT 12A is connected to the scanning line 10, a source electrode thereof is connected to the data line 11*a*, and a drain electrode thereof is connected to the sub-pixel 7A as the pixel electrode. A gate electrode of the TFT 12B is connected to the scanning line 10, a source electrode thereof is connected to the data line 11*b*, and a drain electrode thereof is connected to the sub-pixel 7B as the pixel electrode. A gate electrode of the TFT 12B' is connected to the scanning line 10, a source electrode thereof is connected to the data line 11*c*, and a drain electrode thereof is connected to the sub-pixel 7B' as the pixel electrode.

Also, the source driver 19 includes an input signal converting unit 16, a gradation voltage generator 8, and a selector 9 for selecting one of the gradation level A and the gradation level A+1 based on the predetermined bits in a plurality of bits. The selector 9 is connected through each data line 11 to the source electrode of the TFT 12. The input signal converting unit 16 receives the supplied six bits gradation data (input data) corresponding to the data signal, and outputs five bits in the supplied six bits operated by the input signal converting unit 16 to the gradation voltage generator 8, and outputs two bits in the supplied six bits operated by the input signal converting unit 16 to the selector 9. The selector 9 receives gradation voltages A and A+1 which are generated by the gradation voltage generator 8 using the five bits data, determines a gradation voltage to be sent to the data lines 11*a* and 11*b* based on the upper two bits gradation data outputted from the input signal converting unit 16 (namely, selects one of the gradation level A and the gradation level A+1), and then outputs as the data signal. The selector 9 makes a control such that at least one of the sub-pixel 7A and the sub-pixel 7B represents the selected one of the gradation level A and the gradation level A+1.

Also, the source driver 19 includes an input signal converting unit 16A, a gradation voltage generator 8, and a selector 9 for selecting one of the gradation level A and the gradation level A+1 based on the predetermined bits in a plurality of bits. The input signal converting unit 16A receives the supplied six bits gradation data (input data) corresponding to the data signal, and outputs the upper four bits of the supplied six bits to the gradation voltage generator 8, and outputs the lower two bits of the supplied six bits to the selector 9. The selector 9 receives gradation voltages A and A+1 (gradation level A+1: a gradation whose level is one level higher than that of gradation level A) which are generated by the gradation voltage generator 8 using the upper four bits data, determines a gradation voltage to be sent to the data lines 11*a* and 11*b* based on the lower two bits gradation data outputted from the input signal converting unit 16A (namely, selects one of the gradation level A and the gradation level A+1), and then outputs as the data signal. The selector 9 makes a control such that at least one of a first sub-pixel (for example, the sub-pixel 7A or 7B') and a second sub-pixel (for example, the sub-pixel 7B) represents the selected one of the gradation level A and the gradation level A+1. The second example of the display apparatus according to the third embodiment can be realized by performing data conversion similar to that in FIG. 14B at input signal converting unit 16A.

Next, a third example in which the display apparatus according to the third embodiment is applied to a liquid crystal display will be described below with reference to FIG. 16.

Figure 16:
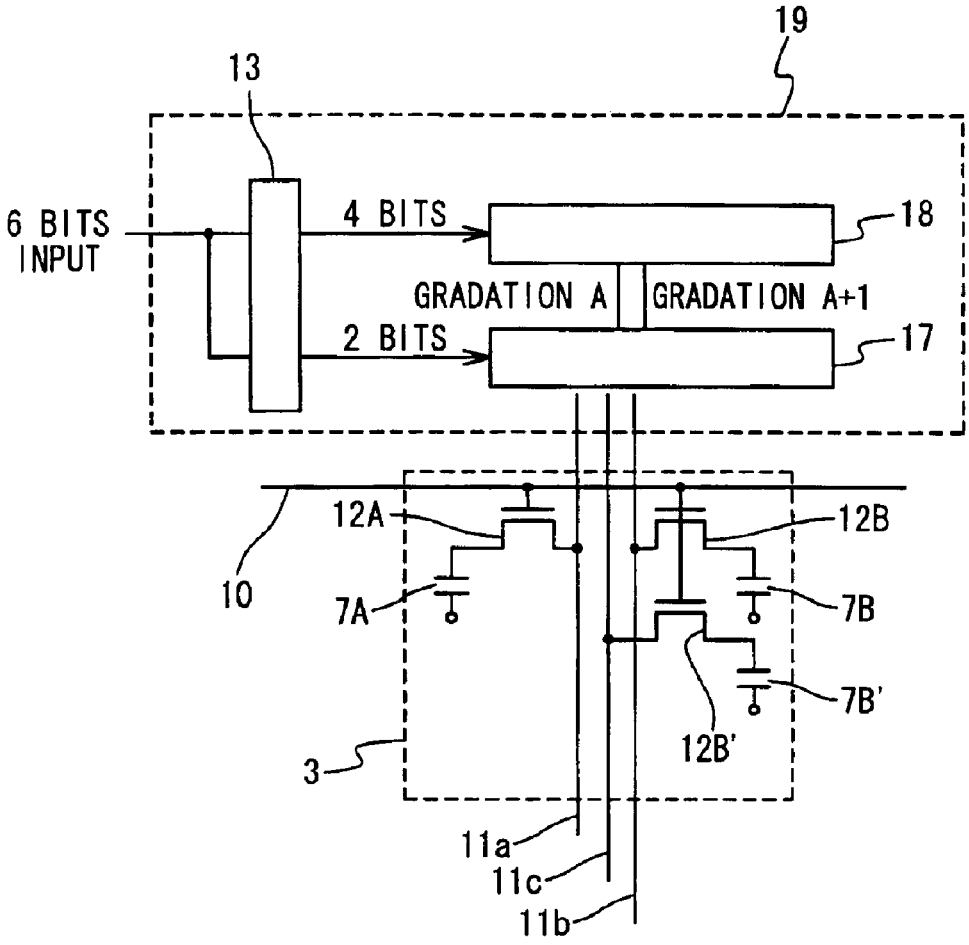
FIG. 16 is a view showing still another configuration of the pixel and the source driver of the display apparatus according to the third embodiment.

FIG. 16 shows still another configuration of a source driver and a pixel of the display apparatus according to the third embodiment.

The display apparatus according to the third embodiment shown in FIG. 16 is the liquid crystal display in which six-bit gradation representation is possible due to the combination of a four bit DAC and the area gradation representation method. FIG. 16 shows a schematic diagram for one pixel in the liquid crystal display. The liquid crystal display is composed of a display panel 4, which includes at least: a pixel 3 provided at each of a plurality of intersections of a plurality of scanning lines (G1, G2, . . . Gn) to which scanning signals are respectively supplied and a plurality of data lines (S1, S2 . . . ) to which data signals are respectively supplied; a gate driver 20 driving such that the scanning signals are sequentially supplied to the scanning lines G1, G2, . . . Gn; and a source driver 19 driving such that the data signals are supplied to the data lines S1, S2, and a control unit 5 which generates a control signal for driving the display panel 4 in response to an external signal, and outputs the control signal to the source driver 19 and the gate driver 20. It should be noted that n is any integer.

The control unit 5 receives an image data, converts the image data into an input data corresponding to the data signal, and outputs the input data to the source driver 19. More specifically, if the number of bits of the supplied gradation data is eight, ten and the like, and is different from six, the control unit 5 converts the gradation data into six bits data, and outputs the digital signal as the input data (data signal) to the source driver 19.

The pixel 3 of the liquid crystal display is composed of three sub-pixels 7A, 7B and 7B'. In this case, the sub-pixel 7A corresponds to the sub-pixel 7G mentioned above, and the sub-pixels 7B and 7B' correspond to the sub-pixels 7E and 7F mentioned above, respectively. It should be noted that an area ratio of the sub-pixel 7A to the sub-pixel 7B is 2:1, and an area ratio of the sub-pixel 7A to the sub-pixel 7B' is 2:1. Thus, the pixel 3 includes a total of three sub-pixels, in which the area ratio is 1:1:2.

The difference between the third example and the first example, in which the display apparatus according to the third embodiment is applied to a liquid crystal display, is in that in the third example a memory 13 capable of storing more than three bits of the supplied six bits.

The sub-pixels 7A, 7B and 7B' correspond to pixel electrodes or capacitors. For example, a TFT (Thin Film Transistor) 12 as a switching element is provided at each intersection in matrix interconnections which are formed by the scanning lines G1, G2, . . . Gn and the data lines S1, S2 . . . . A gate electrode of the TFT 12 is connected to a corresponding one of the scanning lines G1, G2, . . . Gn, a source electrode thereof is connected to a corresponding one of the data lines S1, S2 . . . , and a drain electrode thereof is connected to the pixel electrode.

As shown in FIG. 16, the TFTs (Thin Film Transistors) 12A, 12B and 12B' as switching elements are provided for one pixel at the intersections of a scanning line 10 corresponding to the scanning line G1 and data lines 11*a*, 11*b* and 11*c* corresponding to the data line S1, respectively. A gate electrode of the TFT 12A is connected to the scanning line 10, a source electrode thereof is connected to the data line 11*a*, and a drain electrode thereof is connected to the sub-pixel 7A as the pixel electrode. A gate electrode of the TFT 12B is connected to the scanning line 10, a source electrode thereof is connected to the data line 11*b*, and a drain electrode thereof is connected to the sub-pixel 7B as the pixel electrode. A gate electrode of the TFT 12B' is connected to the scanning line 10, a source electrode thereof is connected to the data line 11*c*, and a drain electrode thereof is connected to the sub-pixel 7B' as the pixel electrode.

Also, the source driver 19 includes a gradation voltage generator 18, a selector 17 for selecting one of the gradation level A and the gradation level A+1 based on the predetermined bits in a plurality of bits, and a memory 13 which stores a plurality of bits. The memory 13 stores the upper four bits and the lower two bits separately with regard to the supplied six bits data which is the gradation data (input data) corresponding to the data signal. The gradation voltage generator 18 receives the upper four bits which are stored in the memory 13, and generates and outputs the gradation level A and the gradation level A+1 whose level is one level higher than that of the gradation level A (higher brightness).

The selector 17 receives gradation voltages A and A+1 which are generated by the gradation voltage generator 18 using the upper four bits data, determines a gradation voltage to be sent to the data lines 11*a* and 11*b* based on the lower two bits gradation data (namely, selects one of the gradation level A and the gradation level A+1), and then outputs as the data signal. Or, the signal conversion is performed such that the lower two bits are stored in the memory 13, to allow 4-gradation-level representation. The selector 17 makes a control such that at least one of a first sub-pixel (for example, the sub-pixel 7A or 7B') and a second sub-pixel (for example, the sub-pixel 7B) represents the selected one of the gradation level A and the gradation level A+1.

Similar to the third example of the display apparatus according to the second embodiments, it is possible to provide two modes in terms of the operational mode in the third example of the display apparatus according to the third embodiment. More specifically, the source driver 19 makes a control such that one of a first mode and a second mode is selected. In the first mode, at least one of the sub-pixels 7A, 7B and 7B' represents one of the gradation level A and the gradation level A+1 based on the plurality of bits of the supplied data (digital signal). In the second mode, multiple-gradation representation is presented based on the bits stored in the memory.

Another mode is for a static image. In case of the static image, since the same data is used for writing the gradation of the pixel, gradation representation is carried out by using the memory 13. In the static image mode, the gradation voltage generator 18 operates so that the upper four bits are stored in the memory 13. The lower two bits are used for selecting each sub-pixel, and the remaining upper bits periodically change the gradation outputted at every frame time. The remaining upper bits realize multiple-gradation representation in the time average, which makes multiple-gradation representation possible.

The configuration mentioned above makes it possible to provide a liquid crystal display in which picture quality and electric power consumption are balanced in the area gradation representation method.

Moreover, in the present example of the display apparatus according to the third embodiment, the liquid crystal display is used as the display apparatus. In addition to that, the display apparatus can be applied to another display apparatus that can represent more than two gradation levels, such as an organic EL. Also, the display apparatus is applicable to a PDP which controls the gradation by the PWM (Pulse Width Modulation) method and a ferroelectric liquid crystal display.

As described above, the display apparatus according to the third embodiment can achieve area gradation representation with further high picture quality in addition to the effects according to the first embodiment and the second embodiment.

A display apparatus according to a fourth embodiment will be described below with reference to FIGS. 17A and 17B, in which the number of gradation levels which can be presented is increased in order to reduce brightness difference between sub-pixels by temporally changing the gradation which the sub-pixel presents every frame. It should be noted that the configuration of the display apparatus in the fourth embodiment is similar to that in the third embodiment, and the explanation is omitted.

Figure 17A:
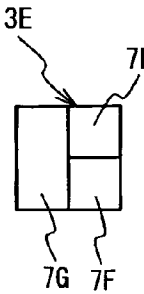
FIG. 17A is a view showing a configuration of a pixel in a display panel of a display apparatus according to a fourth embodiment.
Figure 17B:
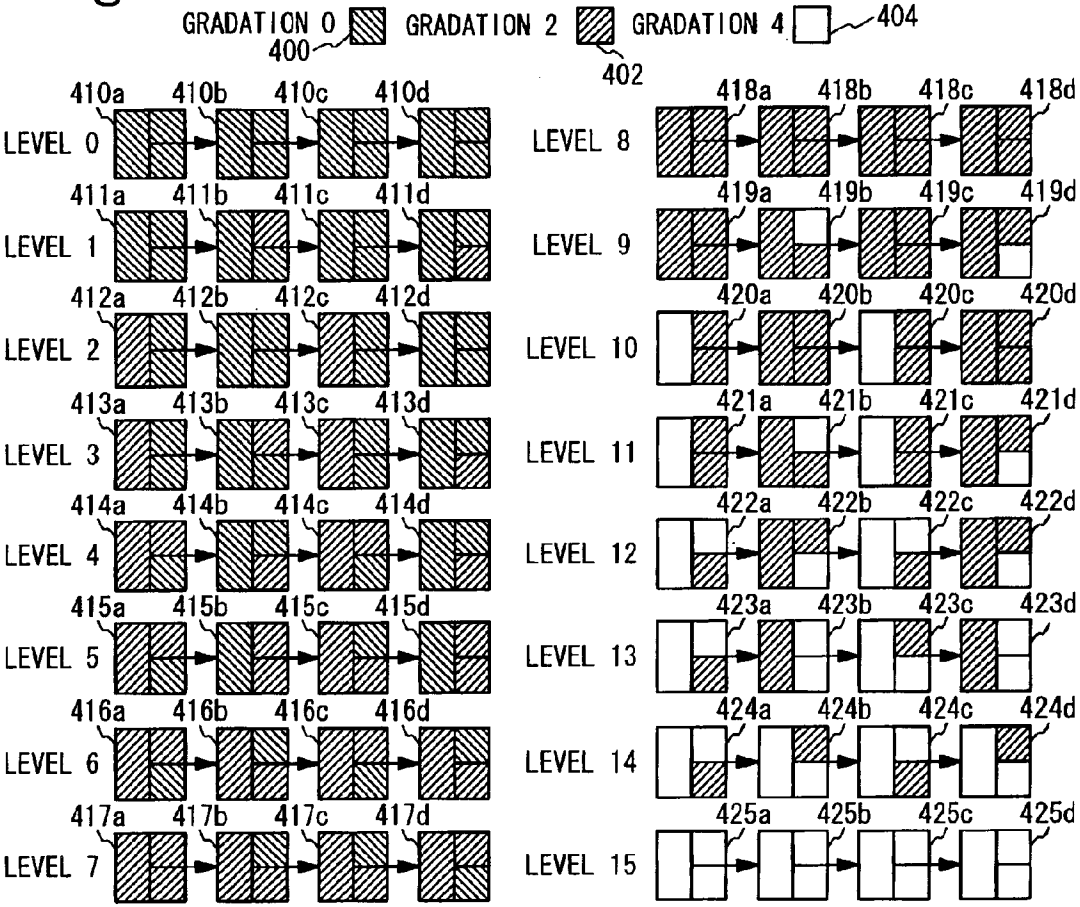
FIG. 17B is a view showing gradation representation with the pixel shown FIG. 17A.

FIG. 17A shows a configuration of a pixel in a display panel of the display apparatus according to the fourth embodiment, and FIG. 17B shows gradation representation using the pixel shown in FIG. 17A.

As shown in FIG. 17A, a numeral 3E indicates a pixel corresponding to the pixel 3 of the display panel 4. The pixel 3E is composed of sub-pixels 7E, 7F and 7G, and an area ratio between the sub-pixels 7E, 7F and 7G is 1:1:2. A case where those sub-pixels are used for 16-gradation-level representation is described. The difference between the display apparatus according to the fourth embodiment and that according to the third embodiment, both of which use the same frame modification method, is that representation at the sub-pixels 7E and 7F with the same area is changed every two frames, and hence the brightness difference in the pixel is reduced.

As shown in FIG. 17B, a numeral 400 indicates a gradation level 0 (for example, black), a numeral 402 indicates a gradation level 2, and a numeral 404 indicates a gradation level 4 (for example, white). Also, as a gradation level shifts from the gradation level 0 to the gradation level 4, the color becomes gradually lighter from "Black" to "White" as shown in FIG. 17B. In level 0 of the 16 levels, representation changes in the order of a numeral 410*a*, a numeral 410*b*, a numeral 410*c* and a numeral 410*d*. All the sub-pixels 7E, 7F and 7G in the numeral 410*a*, the numeral 410*b*, the numeral 410*c* and the numeral 410*d* represent the gradation level 0. In level 1, representation changes in the order of a numeral 411*a*, a numeral 411*b*, a numeral 411*c* and a numeral 411*d*. In the numeral 410*a* and the numeral 410*c*, the sub-pixels 7E, 7F and 7G all represent the gradation level 0. In the numeral 411*b*, the sub-pixels 7F and 7G represent the gradation level 0, and the sub-pixel 7E represents the gradation level 2. In the numeral 411*d*, the sub-pixels 7E and 7G represent the gradation level 0, and the sub-pixel 7F represents the gradation level 2. In level 2, representation changes in the order of a numeral 412*a*, a numeral 412*b*, a numeral 412*c* and a numeral 412*d*. In the numeral 412*a* and the numeral 412*c*, the sub-pixels 7E and 7F represent the gradation level 0 and the sub-pixel 7G represents the gradation level 2. In the numeral 412*b* and the numeral 412*d*, the sub-pixels 7E, 7F and 7G all represent the gradation level 0.

In level 3, representation changes in the order of a numeral 413*a*, a numeral 413*b*, a numeral 413*c* and a numeral 413*d*. In the numeral 413*a* and the numeral 413*c*, the sub-pixels 7E and 7F represent the gradation level 0 and the sub-pixel 7G represents the gradation level 2. In the numeral 413*b*, the sub-pixels 7F and 7G represent the gradation level 0, and the sub-pixel 7E represents the gradation level 2. In the numeral 413*d*, the sub-pixels 7E and 7G represent the gradation level 0, and the sub-pixel 7F represents the gradation level 2. In level 4, representation changes in the order of a numeral 414*a*, a numeral 414*b*, a numeral 414*c* and a numeral 414*d*. In the numeral 414*a* and the numeral 414*c*, the sub-pixels 7E and 7G represent the gradation level 2 and the sub-pixel 7F represents the gradation level 0. In the numeral 414*b* and the numeral 414*d*, the sub-pixels 7E and 7G represent the gradation level 0 and the sub-pixel 7F represents the gradation level 2. In level 5, representation changes in the order of a numeral 415*a*, a numeral 415*b*, a numeral 415*c* and a numeral 415*d*. In the numeral 415*a*, the sub-pixels 7E and 7G represent the gradation level 2 and the sub-pixel 7F represents the gradation level 0. In the numeral 415*c*, the sub-pixels 7F and 7G represent the gradation level 2 and the sub-pixel 7E represents the gradation level 0. In the numeral 415*b* and the numeral 415*d*, the sub-pixels 7E and 7F represent the gradation level 2 and the sub-pixel 7G represents the gradation level 0.

In level 6, representation changes in the order of a numeral 416*a*, a numeral 416*b*, a numeral 416*c* and a numeral 416*d*. In the numeral 416*a* and the numeral 416*c*, the sub-pixels 7E and 7G represent the gradation level 2 and the sub-pixel 7F represents the gradation level 0. In the numeral 416*b* and the numeral 416*d*, the sub-pixels 7F and 7G represent the gradation level 2 and the sub-pixel 7E represents the gradation level 0. In level 7, representation changes in the order of a numeral 417*a*, a numeral 417*b*, a numeral 417*c* and a numeral 417*d*. In the numeral 417*a*, the sub-pixels 7E, 7F, and 7G all represent the gradation level 2. In the numeral 417*b* and the numeral 417*c*, the sub-pixels 7F and 7G represent the gradation level 2 and the sub-pixel 7E represents the gradation level 0. In the numeral 417*d*, the sub-pixels 7E and 7G represent the gradation level 2 and the sub-pixel 7F represents the gradation level 0.

In level 8, representation changes in the order of a numeral 418*a*, a numeral 418*b*, a numeral 418*c* and a numeral 418*d*. The sub-pixels 7E, 7F and 7G in the numeral 418*a*, the numeral 418*b*, the numeral 418*c* and the numeral 418*d* all represent the gradation level 2. In level 9, representation changes in the order of a numeral 419*a*, a numeral 419*b*, a numeral 419*c* and a numeral 419*d*. In the numeral 419*a* and the numeral 419*c*, the sub-pixels 7E, 7F and 7G all represent the gradation level 2. In the numeral 419*b*, the sub-pixels 7F and 7G represent the gradation level 2, and the sub-pixel 7E represents the gradation level 4. In the numeral 419*d*, the sub-pixels 7E and 7G represent the gradation level 2, and the sub-pixel 7F represents the gradation level 4. In level 10, representation changes in the order of a numeral 420*a*, a numeral 420*b*, a numeral 420*c* and a numeral 420*d*. In the numeral 420*a* and the numeral 420*c*, the sub-pixels 7E and 7F represent the gradation level 2 and the sub-pixel 7G represents the gradation level 4. In the numeral 420*b* and the numeral 420*d*, the sub-pixels 7E, 7F and 7G all represent the gradation level 2.

In level 11, representation changes in the order of a numeral 421*a*, a numeral 421*b*, a numeral 421*c* and a numeral 421*d*. In the numeral 421*a* and the numeral 421*c*, the sub-pixels 7E and 7F represent the gradation level 2 and the sub-pixel 7G represents the gradation level 4. In the numeral 421*b*, the sub-pixels 7F and 7G represent the gradation level 2, and the sub-pixel 7E represents the gradation level 4. In the numeral 421*d*, the sub-pixels 7E and 7G represent the gradation level 2, and the sub-pixel 7F represents the gradation level 4. In level 12, representation changes in the order of a numeral 422*a*, a numeral 422*b*, a numeral 422*c* and a numeral 422*d*. In the numeral 422*a* and the numeral 422*c*, the sub-pixels 7E and 7G represent the gradation level 4 and the sub-pixel 7F represents the gradation level 2. In the numeral 422*b* and the numeral 422*d*, the sub-pixels 7E and 7G represent the gradation level 2 and the sub-pixel 7F represents the gradation level 4. In level 13, representation changes in the order of a numeral 423*a*, a numeral 423*b*, a numeral 423*c* and a numeral 423*d*. In the numeral 423*a*, the sub-pixels 7E and 7G represent the gradation level 4 and the sub-pixel 7F represents the gradation level 2. In the numeral 423*c*, the sub-pixels 7F and 7G represent the gradation level 4 and the sub-pixel 7E represents the gradation level 2. In the numeral 423*b* and the numeral 423*d*, the sub-pixels 7E and 7F represent the gradation level 4 and the sub-pixel 7G represents the gradation level 2.

In level 14, representation changes in the order of a numeral 424*a*, a numeral 424*b*, a numeral 424*c* and a numeral 424*d*. In the numeral 424*a* and the numeral 424*c*, the sub-pixels 7E and 7G represent the gradation level 4 and the sub-pixel 7F represents the gradation level 2. In the numeral 424*b* and the numeral 424*d*, the sub-pixels 7F and 7G represent the gradation level 4 and the sub-pixel 7E represents the gradation level 2. In level 15, representation changes in the order of a numeral 425*a*, a numeral 425*b*, a numeral 425*c* and a numeral 425*d*. The sub-pixels 7E, 7F and 7G in the numeral 425*a*, the numeral 425*b*, the numeral 425*c* and the numeral 425*d* all represent the gradation level 4.

Due to such a configuration, the brightness difference is reduced further, and high-quality area gradation representation is possible in the display apparatus according to the fourth embodiment.

As described above, in addition to the effects according to the first to third embodiments, the display apparatus according to the fourth embodiment can achieve area gradation representation with further high picture quality by suppressing the brightness difference.

A display apparatus according to a fifth embodiment will be described below with reference to FIG. 18, in which the number of possible gradation levels is increased in order to reduce -brightness difference between sub-pixels by temporally changing the gradation which the sub-pixel represents every frame. It should be noted that the configuration of the display apparatus in the fifth embodiment is similar to that in the fourth embodiment, and the explanation is omitted.

Figure 18:
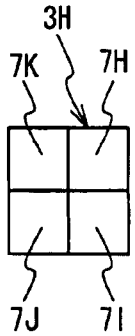
FIG. 18 is a view showing a configuration of a pixel in a display panel of a display apparatus according to a fifth embodiment.
Figure 19A:
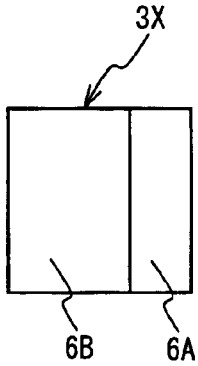
Fig. 19A PRIOR ART
FIG. 19A is a view showing a configuration of a pixel in a display panel of a conventional display apparatus.
Figure 19B:
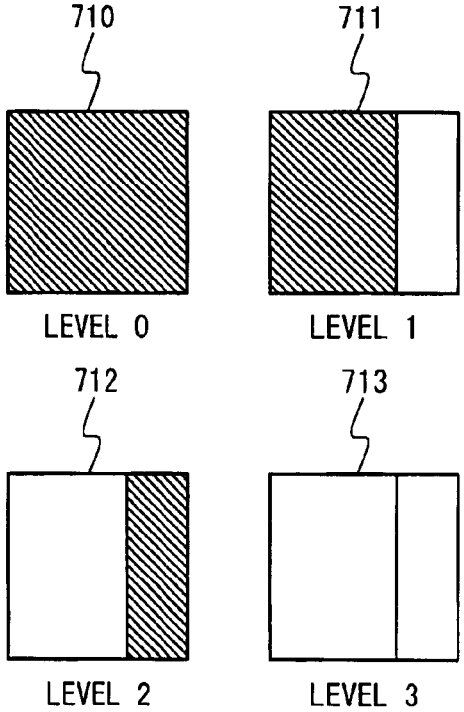
Fig. 19B PRIOR ART
FIG. 19B is a view showing gradation representation in the conventional display apparatus.

FIG. 18 shows a configuration of a pixel in a display panel of the display apparatus according to the fifth embodiment.

The display apparatus according to the fifth embodiment shown in FIG. 18 is an applied example of the display apparatus according to the fourth embodiment. FIG. 18 is a schematic picture of a pixel configuration for the area gradation representation method. A pixel 3H of the liquid crystal display corresponds to the pixel 3 mentioned above, and is composed of four sub-pixels 7H, 7I, 7J and 7K. An area ratio of the four sub-pixels 7H, 7I, 7J and 7K is 1:1:1:1. That is to say, their areas are equal to each other. Due to such a configuration, the frame switching as shown in FIGS. 17A and 17B can be applied to all the pixels, which makes it possible to present area gradation representation in which the brightness difference is suppressed.

As described above, in addition to the effects according to the fourth embodiment, the display apparatus according to the fifth embodiment can achieve area gradation representation with further high picture quality by further suppressing the brightness difference.

INDUSTRIAL APPLICABILITY

In recent years, digitization of picture information has been advanced, which leads to a rapid increase of cases where a picture signal, which has been conventionally transmitted as an analog signal, is transmitted as a digital signal. The display apparatus according to the present invention is a dot matrix display apparatus such as an LCD, and is capable of suppressing deterioration of picture quality caused by the pixel configuration effect in the area gradation representation method which presents gradation representation by dividing a pixel into a plurality of sub-pixels. Also, in the display apparatus according to the present invention, picture quality substantially equivalent to that of an analog gradation representation method can be obtained by a combination with a time division driving method. Also, it is possible in the display apparatus according to the present invention to prevent deterioration of picture quality which is peculiar to the area gradation representation method in the case of gradual gradation representation such as a gradation and so on.

What is claimed is:

1. A display apparatus comprising:

a pixel including a plurality of sub-pixels capable of representing a plurality of gradation levels; and a driver which receives an input data, and outputs a plurality of data signals to said pixel based on said input data to control said plurality of sub-pixels, wherein when a first sub-pixel of said plurality of sub-pixels represents one of a minimum gradation level and a maximum gradation level of said plurality of gradation levels, a second sub-pixel of said plurality of sub-pixels adjacent to said first sub-pixel is always restricted to represent other than the other of said minimum gradation level and said maximum gradation level so that when a first sub-pixel of the pixel represents a minimum gradation level, the other sub-pixels of the pixel are restricted from representing the maximum gradation level and when the first sub-pixel represents a maximum gradation level, the other sub-pixels are restricted from representing the minimum gradation level.

2. The display apparatus according to claim 1, wherein said plurality of sub-pixels carries out gradation representation by using two gradation levels of a first gradation level of said plurality of gradation levels and a second gradation level of said plurality of gradation levels at a time.

3. The display apparatus according to claim 2, wherein said first gradation level is different by one level from said second gradation level.

4. The display apparatus according to claim 3, wherein said driver divides said input data into m frames of data, and scans each of said plurality of sub-pixels m times to represent said first gradation level p times and said second gradation level q times, wherein said p and said q are integers equal to or more than 0, said m is equal to a sum of said p and said q, and values of said p and said q depend on said each of said plurality of sub-pixels.

5. The display apparatus according to claim 4, wherein a number of said plurality of sub-pixels is n (n is an integer equal to or more than 2), and an area ratio of said plurality of sub-pixels is $1:1:2^1:2^2:\ldots:2^{n-2}$.

6. The display apparatus according to claim 4, wherein said plurality of sub-pixels have a same area.

7. The display apparatus according to claim 2, wherein said driver comprises:

a gradation voltage generator which receives a first set of bits in said input data, and generates a first gradation voltage corresponding to said first gradation level and a second gradation voltage corresponding to said second gradation level based on said first set of bits; and a selector which receives a second set of bits in said input data together with said first gradation voltage and said second gradation voltage generated by said gradation voltage generator, and selects one of said first gradation voltage and said second gradation voltage to be sent to each of said plurality of sub-pixels as one of said plurality of data signals based on said second set of bits.

8. The display apparatus according to claim 4, wherein said driver further comprises:

an input signal interchange unit which receives said input data and selects one of a first mode and a second mode of gradation representation; and a memory which stores a plurality of bits of data, wherein in said first mode, said input signal interchange unit outputs a third set of bits in said input data to said gradation voltage generator and a fourth set of bits in said input data to said memory, and said memory outputs said fourth set of bits to said selector, and in said second mode, said input signal interchange unit outputs a fifth set of bits in said input data to said gradation voltage generator and a sixth set of bits in said input data to said memory, and said memory outputs said sixth set of bits to said selector.

9. The display apparatus according to claim 7, wherein said driver further comprises an input signal converting unit which receives said input data, outputs a quotient obtained by dividing said input data by a natural number to said gradation voltage generator, and outputs a residual obtained by dividing said input data by said natural number to said selector.

10. The display apparatus according to claim 7, wherein said driver further comprises:

an input signal converting unit which receives said input data and selects one of a first mode and a second mode of gradation representation; and a memory which stores a plurality of bits of data, wherein in said first mode, said input signal converting unit outputs a quotient obtained by dividing said input data by a natural number to said gradation voltage generator, and outputs a residual obtained by dividing said input data by said natural number to said memory, and said memory outputs said residual to said selector, and in said second mode, said input signal converting unit outputs a sixth set of bits in said input data to said memory, and said memory outputs said sixth set of bits to said selector.

11. The display apparatus according to claim 7, wherein said driver divides said input data into m frames of data, and scans each of said plurality of sub-pixels m times to represent said first gradation level p times and said second gradation level q times, wherein said p and said q are integers equal to or more than 0, said m is equal to a sum of said p and said q, and values of said p and said q depend on said each of said plurality of sub-pixels.

12. The display apparatus according to claim 2, wherein said driver comprises a gradation voltage generator which receives a first set of bits in said input data, generates a first gradation voltage corresponding to said first gradation level and a second gradation voltage corresponding to said second gradation level based on said first set of bits, and outputs said first gradation voltage and said second gradation voltage as said plurality of data signals, and each of said plurality of sub-pixels comprises a selector which receives a second set of bits in said input data together with said first gradation voltage and said second gradation voltage outputted from said gradation voltage generator, and selects one of said first gradation voltage and said second gradation voltage based on said second set of bits.

13. The display apparatus according to claim 12, wherein said driver further comprises:

an input signal interchange unit which receives said input data and selects one of a first mode and a second mode of gradation representation; and a memory which stores a plurality of bits of data, wherein in said first mode, said input signal interchange unit outputs a third set of bits in said input data to said gradation voltage generator and a fourth set of bits in said input data to said memory, and said memory outputs said fourth set of bits to said selector provided for said each of said plurality of sub-pixels, and in said second mode, said input signal interchange unit outputs a fifth set of bits in said input data to said gradation voltage generator and a sixth set of bits in said input data to said memory, and said memory outputs said sixth set of bits to said selector provided for said each of said plurality of sub-pixels.

14. The display apparatus according to claim 13, wherein said pixel further comprises a calculator which receives said sixth set of bits outputted from said memory, performs a calculation based on said sixth set of bits, and outputs a calculation result to at least one of said plurality of sub-pixels.

15. The display apparatus according to claim 12, wherein said driver further comprises:

an input signal converting unit which receives said input data and selects one of a first mode and a second mode of gradation representation; and a memory which stores a plurality of bits of data, wherein in said first mode, said input signal converting unit outputs a quotient obtained by dividing said input data by a natural number to said gradation voltage generator, and outputs a residual obtained by dividing said input data by said natural number to said memory, and said memory outputs said residual to said selector provided for said each of said plurality of sub-pixels, and in said second mode, said input signal converting unit outputs a sixth set of bits in said input data to said memory, and said memory outputs said sixth set of bits to said selector provided for said each of said plurality of sub-pixels.

16. The display apparatus according to claim 2, wherein said driver divides said input data into m frames of data, and scans each of said plurality of sub-pixels m times to represent said first gradation level p times and said second gradation level q times, wherein said p and said q are integers equal to or more than 0, said m is equal to a sum of said p and said q, and values of said p and said q depend on said each of said plurality of sub-pixels.

17. The display apparatus according to claim 1, wherein a number of said plurality of sub-pixels is n (n is an integer equal to or more than 1), and an area ratio of said plurality of sub-pixels is $1:2^1:2^2:\ldots:2^{n-1}$.

18. The display apparatus according to claim 1, wherein a number of said plurality of sub-pixels is n (n is an integer equal to or more than 2), and an area ratio of said plurality of sub-pixels is $1:1:2^1:2^2:\ldots:2^{n-2}$.

19. A method of gradation representation in a display apparatus, comprising:

representing a plurality of gradation levels on a pixel including a plurality of sub-pixels; and controlling said plurality of sub-pixels such that when a first sub-pixel of said plurality of sub-pixels represents one of a minimum gradation level and a maximum gradation level of said plurality of gradation levels, a second sub-pixel of said plurality of sub-pixels adjacent to said first sub-pixel is always restricted to represent other than the other of said minimum gradation level and said maximum gradation level.

20. The method of gradation representation according to claim 19, wherein said plurality of sub-pixels carry out gradation representation by using two gradation levels of a first gradation level of said plurality of gradation levels and a second gradation level of said plurality of gradation levels at a time.

21. The method of gradation representation according to claim 20, wherein said first gradation level is different by one level from said second gradation level.

22. The method of gradation representation according to claim 20, further comprising:

scanning each of said plurality of sub-pixels m times to represent said first gradation level p times and said second gradation level q times, wherein said p and said q are integers equal to or more than 0, said m is equal to a sum of said p and said q, and values of said p and said q depend on said each of said plurality of sub-pixels.

* * * * *